US011959204B2

(12) United States Patent
Oyama

(10) Patent No.: US 11,959,204 B2
(45) Date of Patent: Apr. 16, 2024

(54) FULL-WIDTH TEMPLE DEVICE FOR LOOM

(71) Applicant: TSUDAKOMA KOGYO KABUSHIKI KAISHA, Ishikawa-ken (JP)

(72) Inventor: Katsuya Oyama, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 0 days.

(21) Appl. No.: 17/486,203

(22) Filed: Sep. 27, 2021

(65) Prior Publication Data

US 2022/0119994 A1 Apr. 21, 2022

(30) Foreign Application Priority Data

Oct. 21, 2020 (JP) ..... 2020-176854

(51) Int. Cl.
*D03J 1/22* (2006.01)

(52) U.S. Cl.
CPC ..... *D03J 1/223* (2013.01)

(58) Field of Classification Search
CPC ..... D03J 1/22; D03J 1/223; D03J 1/226
USPC ..... 139/292, 294, 296, 298
See application file for complete search history.

(56) References Cited

U.S. PATENT DOCUMENTS

RE8,956 E * 11/1879 Burns ..... 139/296
355,818 A * 1/1887 Harling ..... D03J 1/22 139/294
2,823,706 A * 2/1958 Parham ..... D03J 1/22 139/301
3,724,509 A * 4/1973 Burgess ..... D03D 39/223 139/294
3,885,600 A 5/1975 Altmann
3,901,290 A * 8/1975 Jindra ..... D03J 1/22 139/294

(Continued)

FOREIGN PATENT DOCUMENTS

DE 2253729 A1 * 7/1974 ..... D03J 1/22
DE 202020102917 U1 6/2020

(Continued)

OTHER PUBLICATIONS

Feb. 21, 2022, European Search Report issued for related EP Application No. 21199453.8.

(Continued)

*Primary Examiner* — Grace Huang
(74) *Attorney, Agent, or Firm* — Paratus Law Group, PLLC

(57) ABSTRACT

A full-width temple device for a loom including: a base body including a base plate; a cover provided on the base plate; and a temple bar accommodated in a space defined by the base plate and the cover, where the temple bar is a ring bar temple constituted by a rod-shaped inner bar and ring temples provided continuously to both sides of the inner bar and having shaft parts for support at both ends. The base body has support parts at both end portions for supporting the ring bar temple on the shall parts. The full-width temple device includes attachment members each detachably attached to each of the support parts and comprising a plate-shaped shaft fixing part having an engaging part formed to engage with a circumferential surface of the shaft part.

9 Claims, 10 Drawing Sheets

(56) References Cited

U.S. PATENT DOCUMENTS 5,092,371 A * 3/1992 Vandeputte ..... D03J 1/22
139/298

FOREIGN PATENT DOCUMENTS

| | | | | |
|---|---|---|---|---|
| GB | 787995 | A | 12/1957 | |
| JP | 2002-069803 | A | 3/2002 | |
| JP | 2005-179786 | A | 7/2005 | |
| JP | 2009-052156 | A | 3/2009 | |
| WO | WO-2018088474 | A1 * | 5/2018 | ..... D03J 1/22 |

OTHER PUBLICATIONS

Feb. 20, 2024, Japanese Office Action issued for related JP Application No. 2020-176854.

* cited by examiner

FULL-WIDTH TEMPLE DEVICE FOR LOOM

CROSS-REFERENCE TO RELATED APPLICATION(S)

This application is based on and claims priority under 35 USC 119 from Japanese Patent Application No. 2020-176854 filed on Oct. 21, 2020, the contents of which are incorporated herein by reference.

TECHNICAL FIELD

The present invention relates to a full-width temple device for a loom including a base body including a base plate provided over a full width of a woven fabric near a cloth fell, a cover provided on the base plate, and a temple bar accommodated in a space defined by the base plate and the cover, and configured to hold a woven fabric over a full width thereof by the base plate, the cover and the temple bar, wherein the temple bar is a ring bar temple constituted by a rod-shaped inner bar and ring temples provided continuously to both sides of the inner bar and having shaft parts for support at both ends.

BACKGROUND ART

For a loom, when weaving a high-density woven fabric, a full-width temple device capable of preventing weave shrinkage of the woven fabric during weaving is widely used. Note that, the full-width temple device includes a base body including a base plate provided over a weaving width (i.e., over a full width of a woven fabric) near a cloth fell, and a cover provided on the base plate. The full-width temple device also includes a temple bar accommodated in a space defined by the base plate and the cover.

In the full-width temple device, the woven fabric is guided into the space in a form of following an upper surface of the cover, is wound on the temple bar in the space and is held over a full width thereof by cooperation of the base plate, the cover and the temple bar.

As the full-width temple device, known is a device where the temple bar is constituted by a ring bar temple whose both end portions are formed to be so-called ring temples. Such full-width temple device is disclosed in Patent Literature 1. In the device (hereinafter, referred to as 'conventional device') disclosed in Patent Literature 1, the ring bar temple has an inner bar (guide rod) and ring temples (temple cylinders) arranged on both sides of the inner bar, and the inner bar and the ring temples are provided on a common center rod. Also, in the conventional device, the ring bar temple is supported at shaft parts of both ends of the center rod, and is arranged in a space defined by the cover (housing part) and the base plate.

CITATION LIST

Patent Literature

Patent Literature 1: U.S. Pat. No. 3,885,600

SUMMARY OF INVENTION

In a loom having the full-width temple device, when performing maintenance on the temple bar, for example, an operation of attaching and detaching the temple bar is performed in the full-width temple device. At this time, since the temple bar is accommodated in the space defined by the base plate and the cover, as described above, when detaching the temple bar, it is necessary to first detach the cover attached to the base plate from the base plate. In a case where the temple bar is the ring bar temple as described above, since the ring bar temple is supported at the shaft parts of both ends, the support state should be released.

However, according to the configuration of the conventional device, it takes time and effort to detach the temple bar, which imposes a burden on an operator. Specifically, the ring bar temple is supported at the shaft parts of both ends and the supporting is made by sidewalls located at both ends of the full-width temple device. In addition, according to the conventional device, both the sidewalls are provided in a form of being attached to outer surfaces of both end portions of the cover.

For this reason, when detaching the cover, it is necessary to perform an operation of detaching both the sidewalls configured to support the ring bar temple on which the woven fabric is wound from the cover. However, on the loom, peripheral devices such as cutter devices and the like are provided on both sides in a weaving width direction (i.e., both sides in a direction of the full width) of the full-width temple device. The peripheral devices are present in nearby positions that hinder the operation of detaching both the sidewalls. Therefore, when performing the operation of detaching each sidewall, an operation of detaching the peripheral devices from the loom should also be first performed. For this reason, according to the configuration of the conventional device, the operation of detaching the ring bar temple is very troublesome and requires efforts.

The present invention has been made in view of the above situations, and an object thereof is to provide a full-width temple device having a ring bar temple with a configuration of facilitating an operation of detaching the ring bar temple.

Solution to Problem

A preamble of the present invention is a full-width temple device for a loom including a base body including a base plate provided over a full width of a woven fabric near a cloth fell, a cover provided on the base plate, and a temple bar accommodated in a space defined by the base plate and the cover, and configured to hold a woven fabric over a full width thereof by the base plate, the cover and the temple bar, wherein the temple bar is a ring bar temple constituted by a rod-shaped inner bar and ring temples provided continuously to both sides of the inner bar and having shaft parts for support at both ends.

In order to achieve the above object, the full-width temple device of the present invention is characterized in that the base body has support parts at both end portions for supporting the ring bar temple on the shaft parts. Also, the full-width temple device is characterized by including attachment members each detachably attached to each of the support parts and including a plate-shaped shaft fixing part having an engaging part formed to engage with a circumferential surface of the shaft part.

In the full-width temple device of the present invention, when the engaging part is a hole-shaped engaging hole formed in the shaft fixing part, each of the shaft parts of the ring bar temple may have a plane shape formed on a part of a circumferential surface thereof, and the engaging hole may be formed into a hole shape in which the shaft part is fitted. In addition, in the full-width temple device, the shaft fixing part of the attachment member is formed with a slit configured to communicate with the engaging hole, a through-hole opening to one facing surface of two facing surfaces of the slit and penetrating through the attachment member in a direction orthogonal to the facing surface, and a female thread hole opening to a position on the other facing surface facing the through-hole. Further, the full-width temple device may include a screw member inserted in the through-hole of the attachment member and screwed into the female thread hole.

Further, in the full-width temple device of the present invention, the ring bar temple may be configured so that the ring temples can be attached and detached with respect to the inner bar, and the cover may be configured to be dividable in positions of both ends of the inner bar or on more inner sides than the positions, regarding a weaving width direction that is a direction of the full width. In addition, the base plate may be configured to be dividable within a presence range of the inner bar with respect to the weaving width direction.

In the present invention, the full-width temple device is configured so that the base body including the base plate has the support parts at both end portions thereof, and the ring bar temple is supported on the base plate by the attachment members attached to the support parts and the support parts. Therefore, according to the configuration, it is possible to detach the cover while maintaining a supported state of the ring bar temple.

In addition, in the full-width temple device, the ring bar temple is supported in a state where the shaft parts are engaged with the engaging parts formed in the shaft fixing parts of the attachment members. Therefore, when the engaged state is made to be in a releasable state, it is possible to form a state where the support of the ring bar temple on the base plate is released, i.e., a state where the ring bar temple can be detached from the base plate. The attachment member is provided so as to be attached and detached with respect to the support part, and the engaged state can be released by detaching the attachment member from the support part. In addition, the configuration (attaching/detaching configuration) for enabling the attachment member to be attached and detached can be implemented by the well-known configuration, and can be made as a configuration for easily attaching and detaching the attachment member with respect to the support part, considering arrangement and the like of the peripheral devices. Therefore, when the attaching/detaching configuration is made as appropriate, the ring bar temple can also be easily detached from the base body.

In this way, according to the full-width temple device of the present invention, by the configuration thereof, an operation of detaching the cover from the base body, which is first performed in an operation of detaching the ring bar temple, can be easily performed, and a configuration of facilitating detaching of the ring bar temple from the base body can also be simply implemented. Thereby, an operation of detaching the ring bar temple can be facilitated.

In the full-width temple device of the present invention, each shaft part of the ring bar temple is formed to have a plane shape on a part of the circumferential surface, and the engaging part of the attachment member is formed into the hole-shaped engaging hole in which the shaft part is fitted. Thereby, a maintenance operation including maintenance or the like of the ring bar temple and an associated operation (an operation of attaching and detaching the ring bar temple, for example) can be more easily performed.

Specifically, as for the ring temple, it is known that a tensile force for a woven fabric is changed by an angle around an axis line in a supported state. The ring bar temple having the ring temples at both ends is also the same. For this reason, the ring bar temple is provided in a support state (angle state) by an angle corresponding to a woven fabric to be woven. The engaging part of the attachment member is configured as an engaging hole, and each shaft part of the ring bar temple and the engaging hole of the attachment member are formed as described above, so that the angle state of the ring bar temple corresponds to a direction in the attachment member (shaft fixing part) of the planar portion of the engaging hole. Therefore, the direction of the planar portion of the engaging hole of the attachment member is set, considering a direction of a plane formed on the shaft part of the ring bar temple and according to the woven fabric to be woven, so that the angle state of the ring bar temple is made to correspond to the woven fabric to be woven simply by inserting the shaft part in the engaging hole so as to attach the ring bar temple to the base body.

In addition, in the maintenance operation, the ring bar temple (ring temple) is detached from the base body for maintenance or the like. As the maintenance or the like is completed, when re-attaching the ring bar temple to the base body, it is necessary to set the angle state of the ring bar temple to be the same as the angle state before the detaching. Regarding this, when the shaft part and the engaging hole are formed as described above, the angle state is made to correspond to the woven fabric to be woven simply by attaching the ring bar temple to the base body, so that it is possible to easily reproduce the angle state of the ring bar temple before the detaching without performing an adjusting operation and the like. Thereby, it is possible to more easily perform the maintenance operation including the attaching and detaching of the ring bar temple with respect to the base body.

Further, in the case where the shaft part of the ring bar temple and the engaging part of the attachment member are formed as described above, the attachment member has the slit configured to communicate with the engaging hole and the screw member screwed into the attachment member with crossing the slit is provided, so that the full-width temple device has a configuration where a so-called split clamping structure is provided as a fixing means for fixing the ring bar temple to the attachment member. According to this configuration, the ring bar temple is fixed to the attachment member in a state where there is no gap between the shaft part and the engaging hole. Thereby, the wear that is caused when there is a gap between the shaft part and the engaging hole is not caused, so that it is possible to increase the service life of the shaft part and the attachment member.

In addition, in the full-width temple device of the present invention, the ring bar temple is configured so that the ring temple can be attached and detached with respect to the inner bar. Further, the cover is configured to be dividable in the positions of both ends of the inner bar in the weaving width direction or on the more inner sides than the positions, so that the maintenance operation can be further facilitated.

Specifically, for the ring bar temple, a target of maintenance thereof is only the ring temple, in many cases. Therefore, when the ring bar temple is configured so that the ring temple can be attached and detached with respect to the inner bar, as described above, only the ring temple of the ring bar temple can be detached while maintaining a state where the woven fabric is wound on the inner bar.

In addition, when the cover is configured to be dividable in the above-described positions, the full-width temple device has a configuration where a range of the ring temple in the space in which the ring bar temple is accommodated can be exposed to an outside, without detaching the entire cover. Therefore, in the maintenance operation, particularly, in the maintenance operation where a target of most maintenance is only the ring temple, it is necessary to detach at least the ring temple from the full-width temple device. As for the detaching of the cover for the detaching of the ring temple, the ring temple can be made in a state where it can be detached simply by detaching the part corresponding to the ring temple. Since only the ring temple can be detached without detaching the entire ring bar temple, the maintenance operation can be facilitated, as a whole.

Further, in the full-width temple device of the present invention, the base plate is configured to be dividable within the presence range of the inner bar in the weaving width direction, so that it is possible to highly deal with a change in weaving width.

Specifically, according to the full-width temple device of the present invention, since both end portions of the woven fabric to be woven are held by the ring temples of the ring bar temple, a ring bar temple having a length adjusted to a weaving width of the woven fabric to be woven is used. Also, in the full-width temple device, in order to avoid interference between needles of the ring temple and the base plate, the base plate is formed with grooves in positions corresponding to the needles of the ring temple. For this reason, a dimension in a length direction of the base plate is adjusted to the ring bar temple having a length adjusted to the weaving width as described above. Therefore, when the weaving width of the woven fabric to be woven is changed, the length dimensions of the ring bar temple and the base plate are changed to correspond to the changed weaving width.

However, when the weaving width is reduced, for example, when the weaving width is changed to a weaving width that cannot be dealt with the length dimensions of the ring bar temple and the base plate, the ring bar temple can deal with the change by cutting an end portion of the inner bar, for example. However, in the case of the base plate, if an end portion thereof is cut, the grooves are not present. That is, the base plate cannot deal with such a change in weaving width. In contrast, the base plate is configured to be dividable as described above, so that the grooves can be left remain on the base plate by cutting an end portion of a part of the base plate on a more inner side than the division position. Thereby, the base plate can deal with the change in weaving width where the weaving width is reduced.

DESCRIPTION OF EMBODIMENTS

Hereinafter, one embodiment of the full-width temple device of the present invention will be described with reference to FIGS. 1 to 7.

Figure 1:
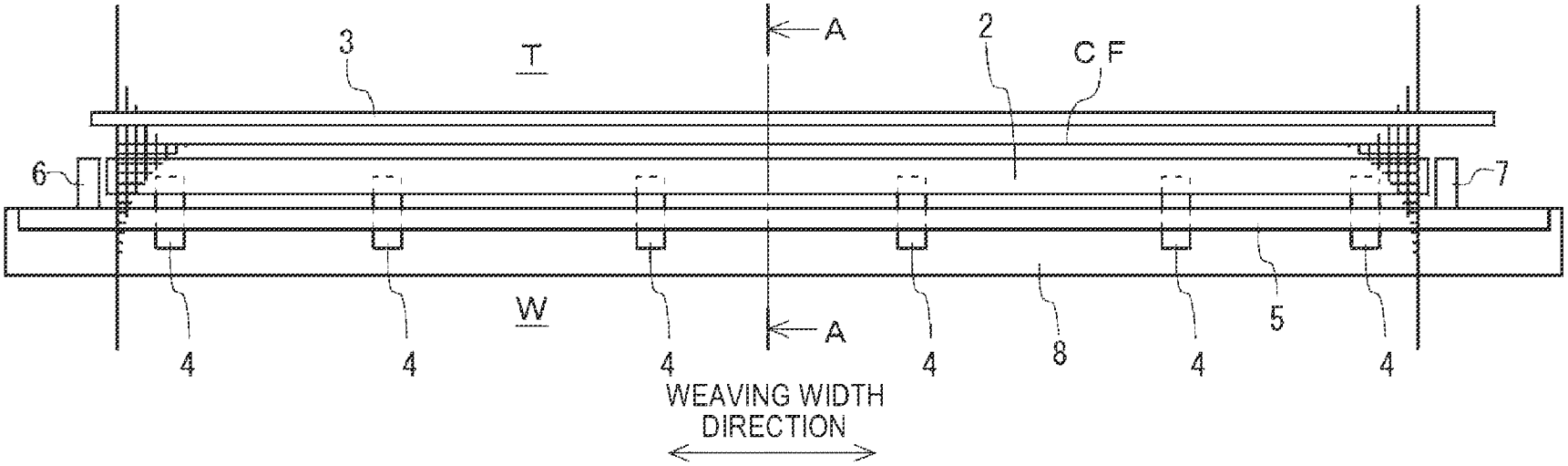
FIG. 1 is a schematic plan view showing an example of a loom having a full-width temple device of the present invention.

As shown in FIG. 1, in a loom 1, a full-width temple device 2 is provided to extend over a weaving width of a woven fabric W to be woven near a cloth fell CF on an opposite side to a reed 3-side (warp row T-side) with respect to the cloth fell CF. Note that, the loom 1 has a front bottom stay 8 bridged between left and right side frames (not shown). A plurality of brackets 4 is attached at intervals in a weaving width direction to the front bottom stay 8. The full-width temple device 2 is supported by the front bottom stay 8 via the plurality of brackets 4.

On the loom 1, an attachment bar 5 longer than the full-width temple device 2 is attached to the plurality of brackets 4 attached to the front bottom stay 8 as described above. The loom 1 also has cutter devices 6 and 7 for cutting wefts to be weft inserted, on a yarn supply-side and on an opposite side to the yarn supply-side. The cutter devices 6 and 7 are arranged near both ends of the full-width temple device 2 in the weaving width direction, in a form of being attached to the attachment bar 5 provided as described above.

Figure 2:
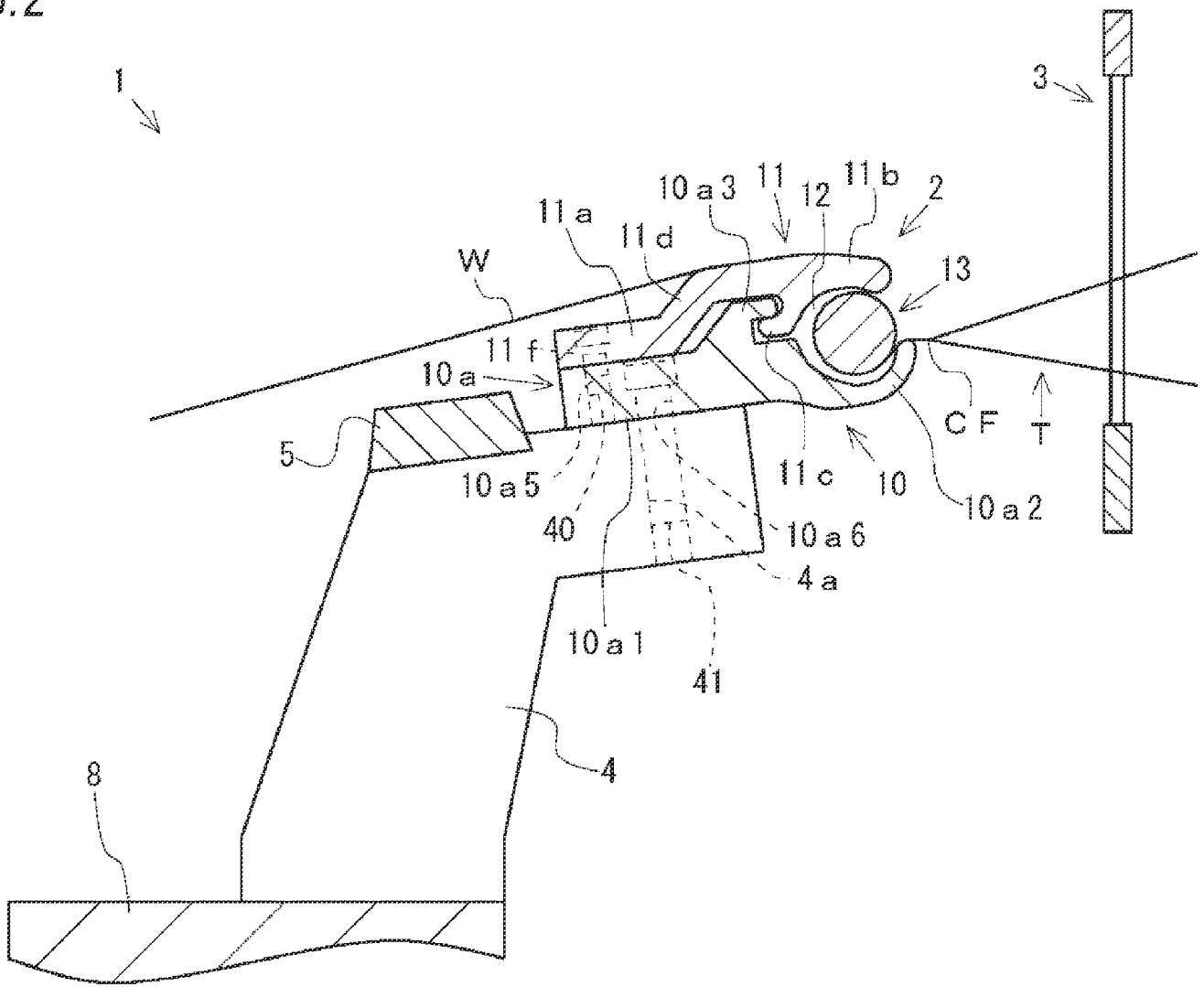
FIG. 2 is a sectional view taken along an A-A line of the full-width temple device shown in FIG. 1.

As shown in FIG. 2, the full-width temple device 2 also has, as main constitutional elements, a base body 10 including a base plate 10*a* attached to the brackets 4, a cover 11 attached to the base plate 10*a*, and a ring bar temple 13 as a temple bar accommodated in a space 12 defined by the base plate 10*a* and the cover 11.

As for the constitutional elements, the base body 10 has, as a main part, the base plate 10*a* that is a long member over the weaving width of the woven fabric W. The base plate 10*a* is constituted by a to-be-attached part 10*al*, which is a portion to be attached to the brackets 4 and the cover 11 is attached thereto, and a base-side guide part 10*a*2 configured to define the space 12 configured to accommodate the ring bar temple 13 together with the cover 11, as described above, and to guide the woven fabric W in cooperation with the ring bar temple 13.

As for the configuration of the base plate 10*a*, the to-be-attached part 10*a*1 has a substantially rectangular plate shape whose dimension in a long side direction is sufficiently longer than a dimension in a short side direction, as seen in a plate thickness direction. The base-side guide part 10*a*2 is formed integrally with the to-be-attached part 10*a*1 in a form of continuing on one end-side of the to-be-attached portion 10*a*1 in the short side direction and existing over the long side direction. Note that, the base-side guide part 10*a*2 has a substantial arc shape, as seen in the long side direction, and is formed so that one end face in the plate thickness direction of the to-be-attached part 10*a*1 is a curved inner surface.

In the shown example, the base plate 10*a* has an engaging part 10*a*3 that is engaged with the cover 11. The engaging part 10*a*3 is formed to protrude from the one end face of the to-be-attached part 10*a*1 and to exist over the long side direction of the to-be-attached part 10*al*, i.e., over a width direction of the base plate 10*a*. In addition, the engaging part 10*a*3 has a substantial L-shape where a tip end-side portion of the protrusion from the to-be-attached part 10*a*1 extends toward the base-side guide part 10*a*2 in the short side direction.

The cover 11 includes an attaching part 11*a* that is a part to be attached to the base plate 10*a* of the base body 10, and a cover-side guide part 11*b* configured to define the space 12 configured to accommodate the ring bar temple 13 together with the base plate 10*a*, as described above, and to guide the woven fabric W in cooperation with the ring bar temple 13.

As for the configuration of the cover 11, the attaching part 11*a* has an elongated rectangular plate shape whose a dimension in a long side direction is substantially the same as the dimension in the long side direction of the to-be-attached part 10*a*1 of the base plate 10*a*, as seen in a plate thickness direction. The cover-side guide part 11*b* has an elongated rectangular plate shape whose a dimension in a long side direction is the same as the dimension in the long side direction of the attaching part 11*a*, as seen in the plate thickness direction. The cover-side guide part 11*b* exists on the cover 11 in a state where the long side direction is made to match the long side direction of the attaching part 11*a*. Therefore, as a whole, the cover 11 has a configuration where a dimension in a width direction, which is the long side direction of the attaching part 11*a*, is substantially the same as the dimension in the width direction of the base plate 10*a*.

In addition, in order to define the space 12 in a state where the cover 11 is attached to the base plate 10*a*, the cover-side guide part 11*b* has a part (facing part) that faces the base-side guide part 10*a*2 of the base plate 10*a* in the plate thickness direction. In other words, the cover 11 is formed to have such a dimension that a part of a tip end-side (an opposite side to the attaching part 11*a*) of the cover-side guide part 11*b* in a state of being attached to the base plate 10*a* becomes the facing part facing the base-side guide part 10*a*2 of the base plate 10*a*, in a front and rear direction that is a short side direction of an end face of the attaching part 11*a*. Additionally describing, in the shown example, the dimension of the cover 11 in the front and rear direction is substantially the same as the dimension of the base plate 10*a* in the front and rear direction, which is the short side direction of the to-be-attached part 10*al*. The facing part of the cover-side guide part 11*b*, which faces the base-side guide part 10*a*2 as described above, is gently curved, as seen in the width direction.

Note that, the cover 11 is formed so that a position of the attaching part 11*a* and a position of the cover-side guide part 11*b* are different in the plate thickness direction, so as to prevent the cover-side guide part 11*b* from interfering with the engaging part 10*a*3 of the base plate 10*a* when the cover 11 is attached at the attaching part 11*a* to the base plate 10*a*. Therefore, the cover 11 has a connecting part 11*d* formed between the attaching part 11*a* and the cover-side guide part 11*b* and extending from the attaching part 11*a* in the plate thickness direction to connect the attaching part 11*a* and the cover-side guide part 11*b*. A positional relationship between the attaching part 11*a* and the cover-side guide part 11*b* is such that an inner surface of the curved part of the facing part of the cover-side guide part 11*b* is directed toward the attaching part 11*a* in the plate thickness direction.

The cover 11 also has a to-be-engaged part 11*c* that is engaged with the engaging part 10*a*3 of the base plate 10*a* of the base body 10. The to-be-engaged part 11*c* is formed to protrude from an end face on the inner surface-side of the cover-side guide part 11*b* in the plate thickness direction and to exist over the width direction of the cover 11. The to-be-engaged part 11*c* also has a substantial L-shape where a tip end-side portion of the protrusion from the cover-side guide part 11*b* extends toward the attaching part 11*a* in the front and rear direction.

Note that, a position of the to-be-engaged part 11*c* is a position in which a surface, which faces toward the tip end-side of the cover-side guide part 11*b*, of the to-be-engaged part 11*c* continues to the inner surface of the cover-side guide part 11*b* with respect to the front and rear direction. The to-be-engaged part 11*c* is also formed so that the surface, which continues to the inner surface, of the cover-side guide part 11*b* is curved with substantially the same curvature as the inner surface. Therefore, the to-be-engaged part 11*c* of the cover 11 also forms the space 12.

Figure 3:
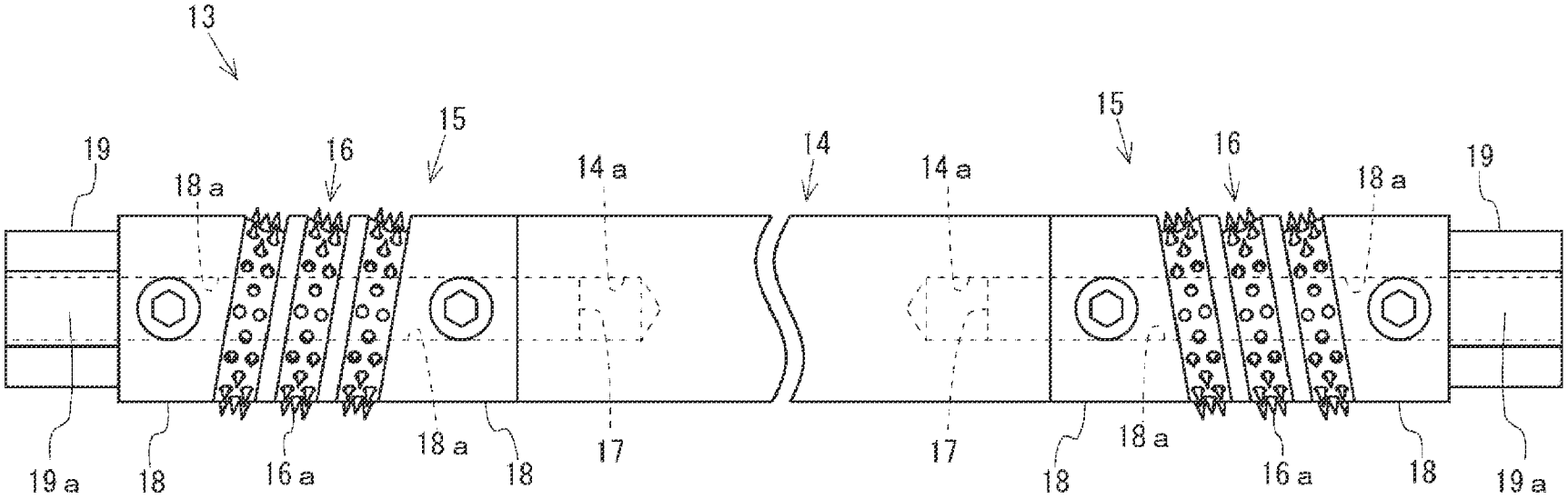
FIG. 3 is a front view of a ring bar temple shown in FIG. 2.
Figure 4:
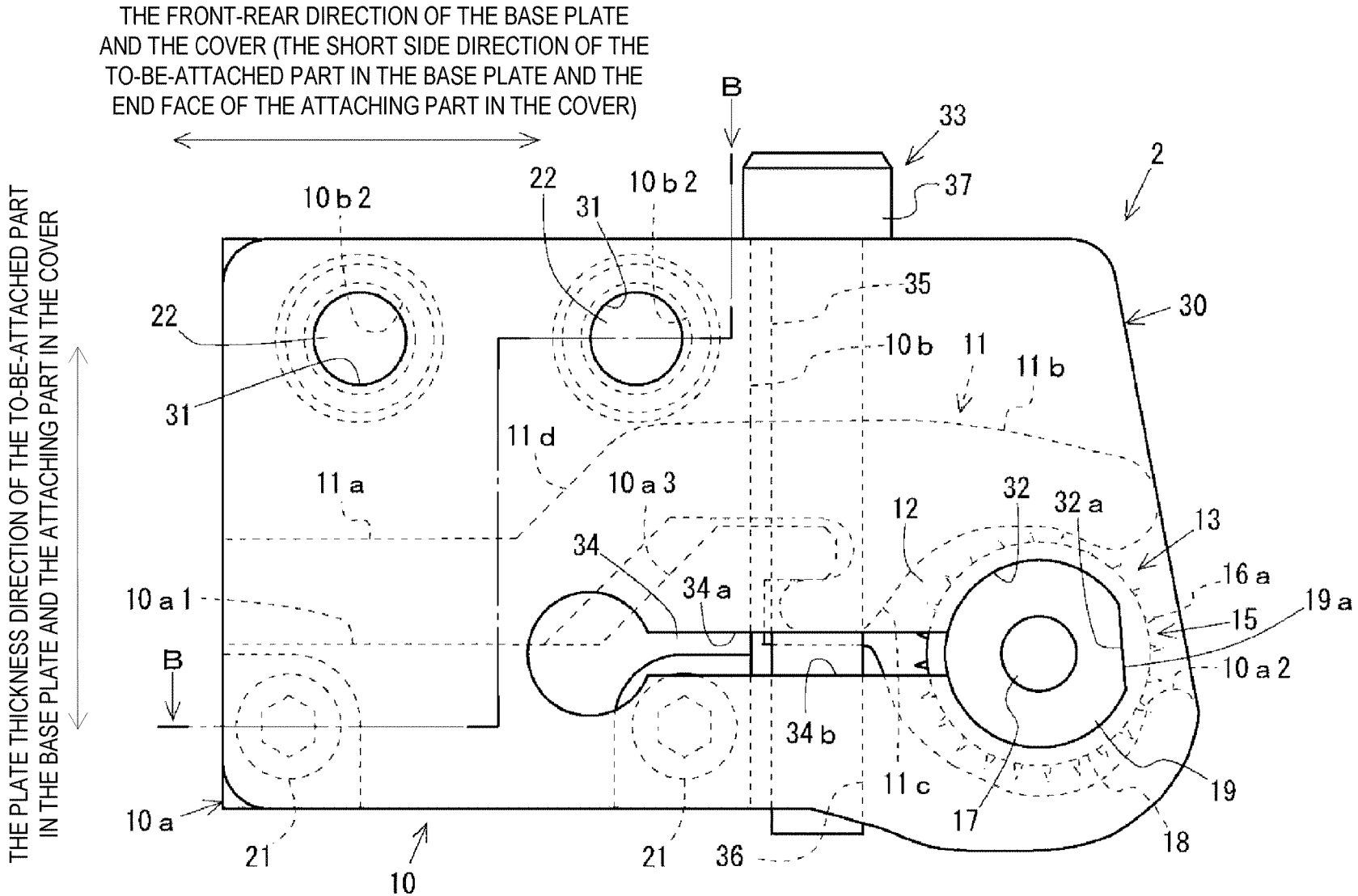
FIG. 4 is a side view of an attachment member to which the ring bar temple shown in FIG. 3 is attached.
Figure 5:
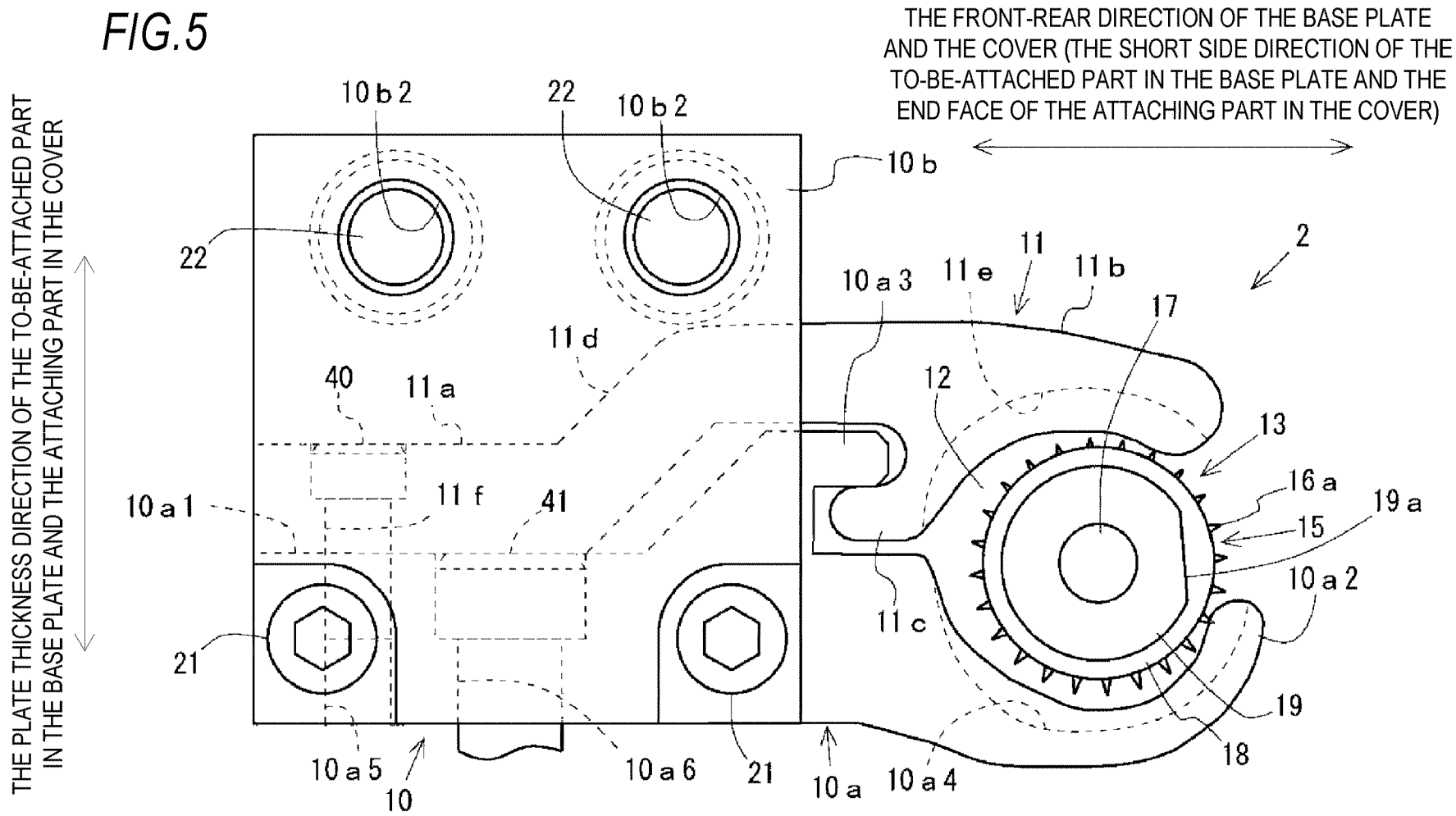
FIG. 5 is a side view of a support part to which the attachment member shown in FIG. 4 is attached.
Figure 6:
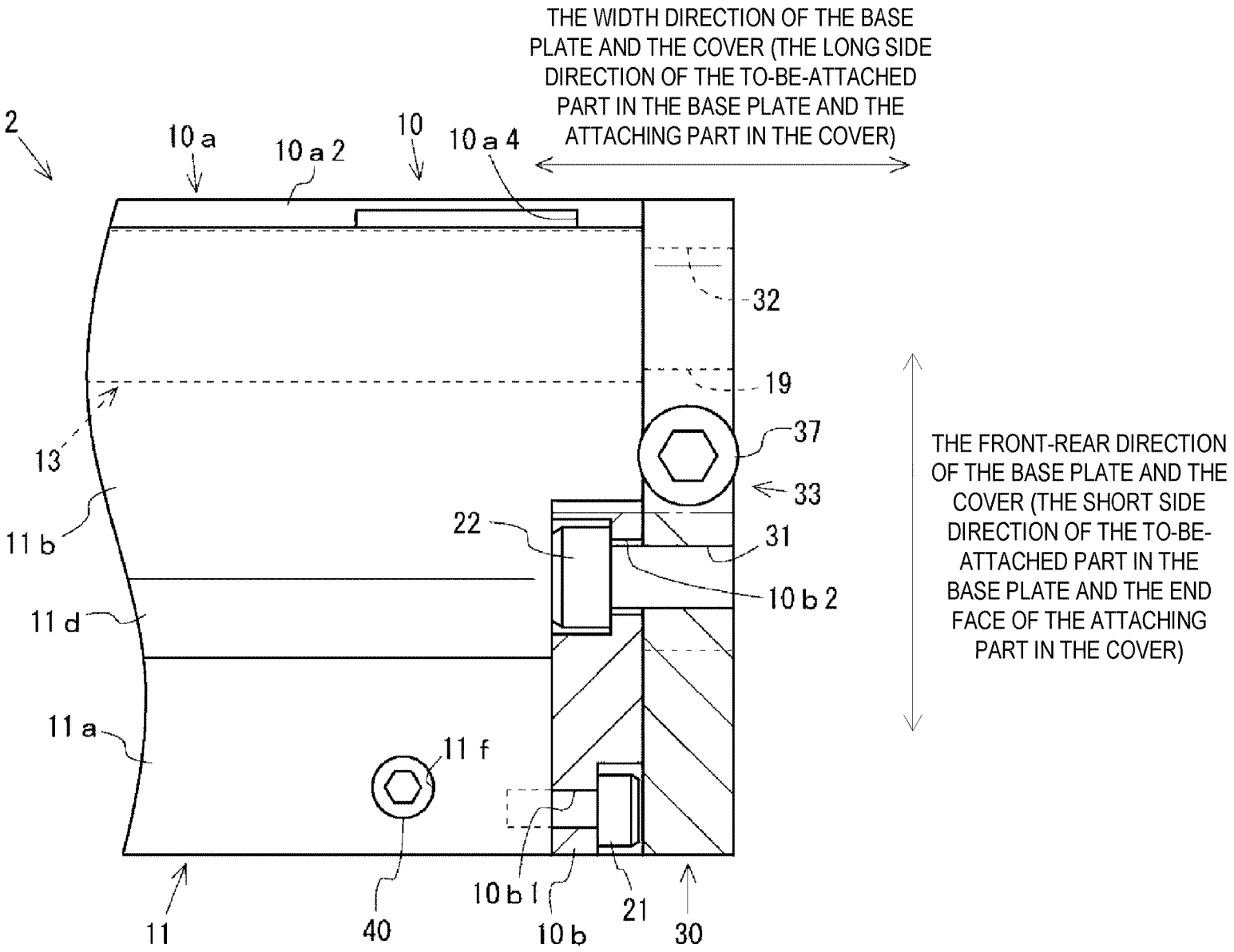
FIG. 6 is a sectional view taken along a B-B line of the attachment member and support part shown in FIG. 4.
Figure 7:
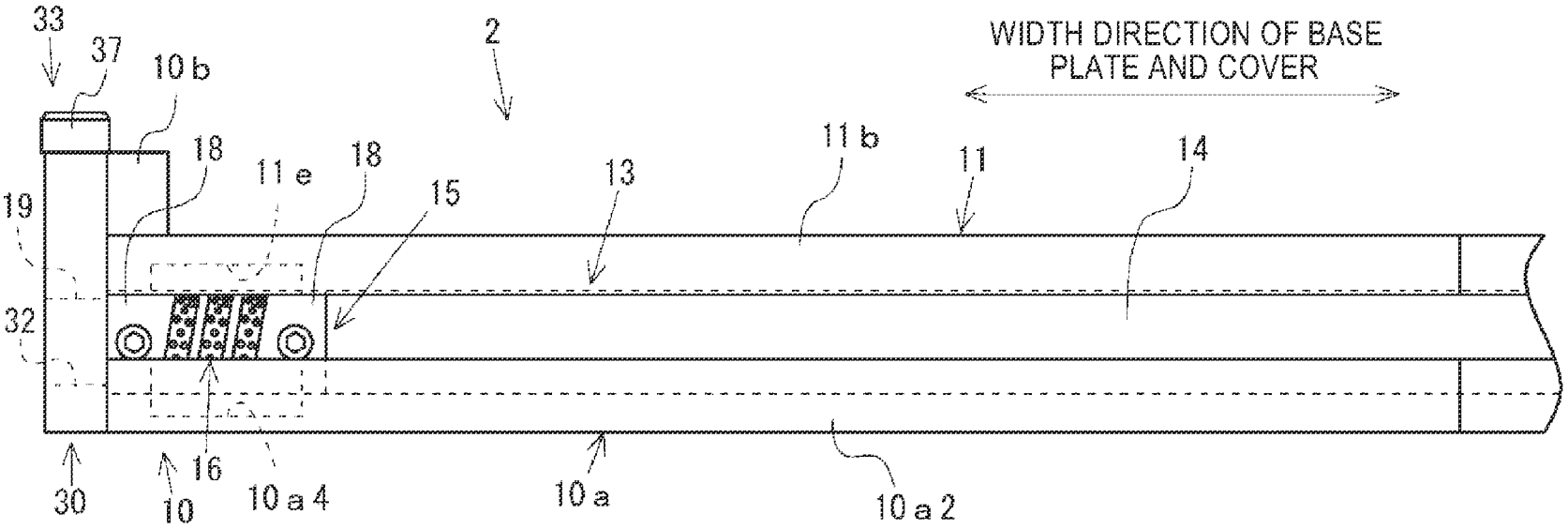
FIG. 7 is a front view of a part of the full-width temple device shown in FIG. 1 on an opposite side to a yarn supply-side.

As shown in FIG. 3, the ring bar temple 13 is constituted by an inner bar 14 formed of a rod-shaped member (round bar) and ring temples 15 and 15 continuing to both sides of the inner bar 14. Note that, each ring temple 15 has a configuration similar to the general ring temple. Specifically, each ring temple 15 includes a plurality of rings 16, a pair of body parts 18 and 18 provided to interpose the plurality of rings 16 therebetween, and a support shaft 17 configured to support each ring 16 and each body part 18.

As for the configuration of each ring temple 15, each ring 16 is a circular plate-shaped member having a through-hole (not shown) formed at a center, and a plurality of needles 16*a* is planted to protrude from an outer peripheral surface of the ring. Note that, the through-hole of each ring 16 has a hole diameter in which the support shaft 17 can be inserted.

Each body part 18 is a substantially cylindrical member having a through-hole 18*a* formed to penetrate through the member in an axis line direction. Note that, a hole diameter of the through-hole 18*a* of each body part 18 is substantially the same as a diameter of the support shaft 17. In addition, one end face of each body part 18 in the axis line direction is formed as an inclined surface inclined relative to a direction orthogonal to the axis line direction.

The plurality of rings 16 of each ring temple 15 is provided on the support shaft 17 in a state of being supported on the support shaft 17 inserted in the through-holes thereof. At this time, each ring 16 is supported on a boss member (not shown) attached to the support shaft 17 in a form of being externally fitted so as to be relatively rotatable in the through-hole. Note that, the boss member is a circular plate-shaped member whose dimension in the plate thickness direction is substantially the same as the ring 16, and is formed in such an aspect that the plate thickness direction of the externally fitted ring 16 is inclined relative to the axis line direction of the support shaft 17. Therefore, in a state of being supported on the support shaft 17 via the boss member, an end face of each ring 16 is inclined relative to the direction orthogonal to the axis line of the support shaft 17, and specifically, is inclined at substantially the same angle as an angle at which the inclined surface of the body part 18 forms with respect to the direction orthogonal to the axis line of the body part 18.

The pair of body parts 18 and 18 are attached on both sides with respect to the plurality of rings 16 provided on the support shaft 17 so as not to be rotatable relative to the support shaft 17, in a state where the support shaft 17 is inserted in the through-holes 18*a*. The attaching is made in a state where the inclined surfaces of the body parts 18 are made to face the rings 16. Each body part 18 of each ring temple 16 is supported on the support shaft 17 in such a form that the inclined surface is in contact with the adjacent ring 16. In addition, each ring temple 15 of the ring bar temple 13 is attached to the inner bar 14 in such a form that a shaft center of the support shaft 17 is made to match a shaft center of the inner bar 14.

In the ring bar temple 13, each ring temple 15 has a protrusion 19 that protrudes from the other end face (an end face on an opposite side to the inclined surface) in the axis line direction of the body part 18 on an opposite side to the inner bar 14. The protrusion 19 has a shaft shape whose diameter is smaller than the body part 18, and protrudes from the other end face in a position in which a shaft center is made to match the shaft center of the body part 18. The protrusion 19 is formed integrally with the body part 18. In addition, the ring bar temple 13 is supported by the base body 10 at the protrusions 19 of the ring temples 15. Therefore, the protrusion 19 of each ring temple 15 is constituted as a shaft part of the ring bar temple 13 for supporting the ring bar temple 13 on the base body 10.

The full-width temple device 2 including the constitutional elements as described above is configured in a form of attaching the cover 11 to the to-be-attached part 10*a*1 of the base plate 10*a* at the attaching part 11*a* in a state where the positions are matched in the width direction and the curved inner surface of the base-side guide part 10*a*2 of the base plate 10*a* is made to face the curved inner surface of the cover-side guide part 11*b* of the cover 11. Note that, in the attached state, the to-be-engaged part 11*c* of the cover 11 is engaged with the engaging part 10*a*3 of the base plate 10*a*.

The attaching is also made using a screw member 40. Therefore, the attaching part 11*a* of the cover 11 is formed with a through-hole 11*f*, in which the screw member 40 is inserted, so as to penetrate through the attaching part 11*a* in the plate thickness direction. On the other hand, the to-be-attached part 10*a*1 of the base plate 10*a* is formed with a female thread hole in which the screw member 40 is screwed, so as to face the through-hole 11*f* of the attaching part 11*a*.

By the attaching, the space 12 configured to accommodate the ring bar temple 13 is defined by the base-side guide part 10*a*2 of the base plate 10*a* and the cover-side guide part 11*b* and to-be-engaged part 11*c* of the cover 11. In the attached state, a tip end of the base-side guide part 10*a*2 is spaced from a tip end of the cover-side guide part 11*b*, so that the space 12 is partially opened to an outside on the tip end-sides. Note that, a dimension of the opened portion (an interval between the tip end of the base-side guide part 10*a*2 and the tip end of the cover-side guide part 11*b*) is smaller than the diameter of the inner bar 14 of the ring bar temple 13, so that the ring bar temple 13 does not separate from the opened portion.

The ring bar temple 13 is accommodated in the space 12 defined as described above. The full-width temple device 2 configured as described above is attached to the brackets 4 at the to-be-attached part 10*a*1 of the base plate 10*a* in a state where the opened portion of the space 12 is made to face toward the cloth fell CF, as described above. Thereby, the full-width temple device 2 is provided on the loom 1 in a form of being supported on the front bottom stay 8. Note that, the to-be-attached part 10*a*1 of the base plate 10*a* is attached to the bracket 4 by using a screw member 41. Therefore, the to-be-attached part 10*a*1 of the base plate 10*a* is formed with a through-hole 10*a*6, in which the screw member 41 is inserted, so as to penetrate through the to-be-attached part 10*a*1 in the plate thickness direction. On the other hand, the bracket 4 is formed with a female thread hole 4*a*, in which the screw member 41 is screwed, so as to face the through-hole 10*a*6 of the to-be-attached part 10*a*1.

Additionally describing, in the loom 1, the manufactured woven fabric W is introduced from the cloth fell CF into the space 12 via the tip end of the base-side guide part 10*a*2 of the full-width temple device 2, and is wound on the ring bar temple 13 in the space 12. In addition, in the full-width temple device 2, the woven fabric W is turned toward the tip end-side of the cover-side guide part 11*b* in the space 12 and is guided along an upper surface of the cover-side guide part 11*b* via the tip end of the cover-side guide part 11*b*.

Thereby, in the full-width temple device 2, the ring bar temple 13 is urged toward the opened portion (the tip ends of the base-side guide part 10*a*2 and the cover-side guide part 11*b*) of the space 12 by the tension of the wound woven fabric W. As a result, within a range of the inner bar 14 of the ring bar temple 13, the woven fabric W is held (sandwiched) by the inner bar 14 and the base plate 10*a* and the cover 11. In addition, within a range of each ring temple the woven fabric W is held by the needles 16*a* of each ring 16. Therefore, the woven fabric W is held over its entire width by the ring bar temple 13 and the base plate 10*a* and the cover 11.

In the full-width temple device 2 as described above, in the present invention, the base body 10 is provided at both end portions thereof with support parts for supporting the ring bar temple 13 at the shaft parts 19. Also, the full-width temple device 2 has attachment members each detachably attached to the support part and including a plate-shaped shaft fixing part having an engaging part formed to engage with a circumferential surface of the shaft part 19 of the ring bar temple 13. One embodiment (present embodiment) of the full-width temple device 2 is described in detail with reference to FIGS. 4 to 7.

In the full-width temple device 2, the base body 10 has support parts 10*b* for supporting the ring bar temple 13 on the base plate 10*a*. The support part 10*b* is a plate-shaped member and has a rectangular shape, as seen in a plate thickness direction. The support part 10*b* also has through-holes 10*b*1, in which screw members 21 for attaching the support part 10*b* to the base plate 10*a* are inserted, at portions (one end portion) on one end-side in a long side direction of an end face. Two through-holes 10*b*1 are formed at an interval in a short side direction of the end face of the support part 10*b*.

The support part 10*b* is attached to the base plate 10*a* on each of both sides in the width direction of the base plate 10*a* of the base body 10. More specifically, the to-be-attached part of the base plate 10*a* is formed with two female thread holes (not shown) opening on each of both side surfaces in the long side direction thereof at the same interval as the through-holes 10*b*1 and 10*b*1 of the support part 10*b*. The screw members 21 inserted in the through-holes are screwed into the female thread holes of the base plate 10*a*, so that each support part is attached to the base plate 10*a*.

The attaching is performed in a direction in which a portion (other end portion) on the other end-side in the long side direction of the support part 10*b* is positioned on the engaging part 10*a*3-side with respect to the to-be-attached part 10*al*, in the plate thickness direction of the to-be-attached part 10*al*. Therefore, in the attached state, each support part 10*b* is in a state of being erected from the to-be-attached part 10*a*1 toward the engaging part 10*a*3 of the base plate 10*a* of the base body 10.

Note that, a dimension in the long side direction of each support part 10*b* is greater than a dimension (a dimension from an end face of the base plate 10*a* (to-be-attached part 10*a*1) attached to the bracket 4 to the upper surface of the cover-side guide part 11*b* of the cover 11) in the plate thickness direction of a combined body of the cover 11 and the base plate 10*a* in a state where the cover 11 is attached to the base plate 10*a* and both are combined. Therefore, in a state where the cover 11 is attached to the base body 10 including the support part 10*b*, the other end portion of each support part 10*b* is located in a position that does not overlap the cover 11.

The full-width temple device 2 also has an attachment member 30 provided for each support part 10*b* of the base body 10 so that the ring bar temple 13 is supported on the base body 10 configured as described above. Each attachment member 30 is a plate-shaped member, and has a substantially rectangular shape, as seen in a plate thickness direction. Note that, a dimension in a short side direction of an end face of each attachment member 30 is substantially the same as the dimension in the long side direction of the support part 10*b*. Also, a dimension in a long side direction of the end face of each attachment member 30 is substantially the same as the dimensions of the base plate 10*a* and the cover 11 in the front and rear direction.

Each attachment member 30 is provided in a form of being detachably attached to the corresponding support part 10*b*. To this end, each support part 10*b* is formed with through-holes 10*b*2 in which screw members 22 for attaching the attachment member 30 to the support part 10*b* are inserted. The through-holes 10*b*2 are formed by two at an interval in the short side direction of the support part 10*b* at the other end portion of the support part 10*b*. Note that, each attachment member 30 is formed with two female thread holes 31 and 31 at the same interval as the through-holes 10*b*2 and 10*b*2 at the other end portion of the support part 10*b*. The positions of both the female thread holes 31 and 31 of each attachment member 30 are positions in which the attachment member 30 overlaps the space 12 of the combined body, as seen in the width direction, when the attachment member 30 is attached to the support part 10*b* of the base body 10.

In addition, the screw members 22 inserted in the through-holes 10*b*2 formed at the other end portion of the corresponding support part 10*b* are screwed into the female thread holes 31, so that each attachment member 30 is attached to the support part 10*b*. At this time, the attaching is performed in a form of inserting the screw members 22 into the through-holes 10*b*2 of the support part 10*b* from an inner side of the base body 10 with respect to the support part 10*b*, in a state where the attachment member 30 is made to face an outer end face of each support part 10*b* of the base body 10 in the width direction.

In addition, the attaching is performed in a direction in which the attachment member 30 overlaps the space 12 of the combined body, as seen in the width direction. Note that, in the attached state, the screw members 21 for fixing the support part 10*b* to the to-be-attached part 10*a*1 overlap the attachment member 30, as seen in the width direction. Therefore, in order to enable a head portion of the screw member 21 to be arranged between the attachment member 30 and the support part 10*b*, the outer end face of each support part 10*b* of the base body 10 is formed with a concave portion in which a portion, with which the head portion of the screw member 21 is in contact, is concave with respect to a portion other than the contact portion.

Note that, a hole diameter of the through-hole 10*b*2 at the other end portion of the support part 10*b* is slightly greater than a diameter of the screw member 22 that is inserted in the through-hole 10*b*2. Thereby, in the full-width temple device 2, the attaching position of the attachment member 30 to the support part 10*b* can be adjusted.

Each attachment member 30 also has an engaging part 32 that is engaged with a circumferential surface of the shaft part 19 of the ring bar temple 13, so as to support the ring bar temple 13 in a state of being attached to the support part 10*b* as described above. In the present embodiment, each of the plate-shaped attachment members 30 each having the engaging part 32 corresponds to the shaft fixing part of the present invention, as a whole. In addition, in the present embodiment, the engaging part 32 of each attachment member 30 is constituted by an engaging hole formed to penetrate through the attachment member 30 in the plate thickness direction.

A hole diameter of the engaging hole 32 of each attachment member 30 is substantially the same as the diameter of the shaft part 19 of the ring bar temple 13. Therefore, the ring bar temple 13 is supported by both the attachment members 30 and 30 in such an aspect that the shaft parts 19 are fitted in the engaging holes 32 of the attachment members 30. A position of the engaging hole 32 of the attachment member 30 is set as a position in which the holding (sandwiching) of the woven fabric W is implemented within the range of the inner bar 14 of the ring bar temple 13 in the supported state, in a state where the attachment member 30 is attached to the support part 10*b*. Each attachment member 30 is attached to the support part 10*b* in the state where the ring bar temple 13 is supported as described above, so that the ring bar temple 13 is supported by the base body 10.

Note that, in the present embodiment, each shaft part 19 of the ring bar temple 13 has such a shape that a part of the circumferential surface is formed planar. Specifically, each shaft part 19 has a planar portion 19*a* formed on the circumferential surface. Regarding this, each engaging hole 32 is formed so that a part of an inner peripheral surface is a plane having substantially the same size as the planar portion 19*a* of the circumferential surface of the shaft part 19 so as for the inner peripheral surface to contact the planar portion 19*a* of the shaft part 19. Specifically, the inner peripheral surface of each engaging hole 32 has a planar contact surface 32*a* that is in contact with the planar portion 19*a* of the shaft part 19. In this way, each engaging hole 32 has a hole shape that is fitted with the shaft part 19 in a state where it is in contact (engaged) with the shaft part 19 over the entire circumference of the inner peripheral surface.

Each shaft part 19 and each engaging hole 32 are formed as described above, so that, in the state where the ring bar temple 13 is supported by the base body 10 as described above, an angle of the ring bar temple 13 around the axis line corresponds to a direction of the contact surface 32*a* of the engaging hole 32 of each attachment member 30. Note that, as used herein, the direction of the contact surface 32*a* corresponds to an angle of the contact surface 32*a* with respect to the long side direction (the short side direction), when seeing the attachment member 30 in the plate thickness direction. The direction of the contact surface 32*a* is set according to the woven fabric W (a tensile force desired for the woven fabric W) to be woven, considering a direction of the planar portion 19*a* of each shaft part 19 of the ring bar temple 13 around the axis line thereof.

In a state where the ring bar temple 13 is supported by the base body 10 as described above, each ring temple 15 is also in a state of being close to the base plate 10*a* and the cover 11. Note that, in the present embodiment, the ring bar temple 13 is configured so that the needles 16*a* of each ring 16 of each ring temple 15 protrude from the outer peripheral surface of the inner bar 14, as seen in the axis line direction. Therefore, in the full-width temple device 2, the base plate 10 and the cover 11 are formed with concave portions at portions facing each ring temple 15 so as to avoid interference of the needles 16*a* of each ring 16 of each ring temple 15 with the base plate 10*a* and the cover 11.

Specifically, the curved inner surface of the base-side guide part 10*a*2 of the base plate 10*a* is formed with a base-side concave part 10*a*4 that is concave over a presence range of the plurality of rings 16 in the axis line direction of each ring temple 15. In addition, the inner surface of the curved portion of the cover-side guide part 11*b* of the cover 11 and the surface (the surface continuing to the inner surface of the cover-side guide part 11*b*) of the to-be-engaged part 11*c* are formed with a cover-side concave part 11*e* that is concave over a range similar to the range in the width direction of the base-side concave part 10*a*4 of the base plate 10*a*. Thereby, in the full-width temple device 2, in the state where the ring bar temple 13 is supported by the base body 10 as described above, the needles 16*a* of each ring 16 of the ring bar temple 13 do not interfere with the base plate 10*a* and the cover 11.

In the state of being supported by the base body 10 as described above, the ring bar temple 13 is fixed to each attachment member 30. Also, in the present embodiment, a split clamping structure is used as a fixing means for the fixing.

As for the split clamping structure, a split clamping structure 33 is configured to include a slit 34 formed to communicate with the engaging hole 32 of the attachment member 30, and a screw member 37 that is screwed into the attachment member 30 in a form of crossing the slit 34.

More specifically, in each attachment member 30, the slit 34 is formed to penetrate through the attachment member 30 in the plate thickness direction, and to extend from the engaging hole 32 in the long side direction of the attachment member 30. Note that, a position of the engaging hole 32 that communicates with the slit 34 is a position near a central portion of the engaging hole 32 in the short side direction of the attachment member 30, on an opposite side to the opening side of the space 12 with respect to a center of the engaging hole 32 in the long side direction of the attachment member 30, when seeing the full-width temple device 2 in the width direction. Also, a position of the inner peripheral surface of the engaging hole 32 that communicates (opens) with the slit 34 is different from the position of the contact surface 32*a*, and in the shown example, is a position facing the contact surface 32*a*. Additionally describing, in the shown example, each attachment member 30 is formed with a through-hole penetrating through the attachment member in the plate thickness direction so as to communicate with the slit 34 on an opposite side to a side of the slit 34 that communicates with the engaging hole 32. Note that, a hole diameter of the through-hole that communicates with the slit 34 is formed greater than an interval between two facing surfaces 34*a* and 34*b* of the slit 34.

The screw member 37 is screwed into each attachment member 30 in the form of crossing the slit 34, as described above. Specifically, the screw member 37 is inserted in the attachment member 30 in such a form that an axis line is made to match the short side direction of the attachment member 30 within a range of the slit 34 in the long side direction of the attachment member 30.

Therefore, the attachment member 30 is formed with a through-hole 35 formed in a portion on one side of the slit 34 in the short side direction, penetrating in the short side direction, and opening to one facing surface 34*a* of the two facing surfaces 34*a* and 34*b* of the slit 34. On the other hand, the other side of the slit 34 in the short side direction of the attachment member 30 is formed with a female thread hole 36 penetrating a portion on the other side in the short side direction, opening to the other facing surface 34*b* and facing the through-hole 35 via the slit 34. In the shown example, the portion on one side in which the through-hole 35 is formed is a portion that is an upper side with respect to the slit 34 in a state where the full-width temple device 2 is mounted on the loom 1.

In the full-width temple device 2 where the attachment member 30 is provided with the split clamping structure 33, the screw member 37 inserted in the through-hole 35 of the attachment member 30 is screwed into the female thread hole 36 via the slit 34 and is tightened, so that the shaft part 19 fitted in the engaging hole 32 configured to communicate with the slit 34 is tightened. Thereby, the ring bar temple 13 is fixed to the attachment member 30.

Note that, each attachment member 30 is attached to the support part 10*b* as described above and is thus provided on the full-width temple device 2. At this time, in the present embodiment, an interval between both the attachment members 30 in the width direction is substantially the same as the dimension of the base plate 10*a* (base-side guide part 10*a*2) in the width direction.

More specifically, both side parts of the base plate 10*a* in the width direction are formed at portions, to which the support parts 10*b* are attached, with concave portions that are recessed by a thickness of each of the support parts 10*b*. Thereby, in the state where the support parts 10*b* are attached to the base plate 10*a*, positions of the outer end faces of the support parts 10*b* are substantially matched with positions of the outermost portions of both side surfaces of the base plate 10*a*, with respect to the width direction. Note that, both side parts of the cover 11 in the width direction are formed with concave portions configured to enable the support parts 10*b* attached to the base plate 10*a* in this way to be arranged. Thereby, the positions of the outer end faces of the support parts 10*b* in the attached state are also substantially matched with positions of the outermost portions of both side surfaces of the cover 11, with respect to the width direction.

In the full-width temple device 2, each attachment member 30 is attached to each of the support parts 10*b* attached to the base plate 10*a*, as described above, and a position of the inner (support part 10*b*-side) end face is matched with the position of the outer end face of the support part 10*b*, with respect to the width direction. Therefore, the interval between both the attachment members 30 and 30 is substantially the same as the dimension of the base plate 10*a* (a dimension between the outermost portions of both side surfaces), with respect to the width direction.

Also, in the ring bar temple 13, since the shaft part 19 has the diameter smaller than the body part 18, as described above, each ring temple 15 has an outer end face (a surface beyond the presence range of the shaft part 19 in the end face on the other side), which faces toward an outer side in the axis line direction of the body part 18, between the shaft part 19 and the body part 18 on an opposite side to the inner bar 14-side. Also, in the present embodiment, an interval between both outer end faces of the ring bar temple 13 in the axis line direction is substantially the same as the dimension of the base plate 10*a* in the width direction, i.e., the interval between both the attachment members 30 and 30 in the width direction.

Therefore, in the state of being supported on the base body 10, as described above, the outer end faces of the ring bar temple 13 are in contact with the inner end faces of the attachment members 30 of the base body 10. Thereby, in the supported state, the position of the ring bar temple 13 in the width direction is restrained by both the attachment members 30 and 30.

In addition, each ring temple 15 of the ring bar temple 13 is attached to the inner bar 14 in such a form that the shaft center of the support shaft 17 is made to match the shaft center of the inner bar 14. Further, in the present embodiment, each ring temple 15 of the ring bar temple 13 is configured to be attached and detached with respect to the inner bar 14.

More specifically, each ring temple 15 is attached to the support shaft 17 in such a form that the plurality of rings 16 is interposed between the pair of body parts 18 and 18. Also, a length dimension of the support shaft 17 is greater than a dimension from an end face of the shaft part 19 of the ring temple 15 to an end face (an end face on an opposite side to the inclined surface) on the other side of the body part 18 on an opposite side to the shaft part 19-side. In addition, the attaching of the shaft part 19 to the support shaft 17 of the body part 18 is performed in a state where a position of the end face of the shaft part 19 is made to substantially match a position of an end face on one side of the support shaft 17. Therefore, in each ring temple 15, an end portion (other end portion) on the other side of the support shaft 17 protrudes from the body part 18 on an opposite side to the shaft part 19-side.

Note that, the inner bar 14 is formed with insertion holes 14*a*, in which the support shafts 17 of the ring temples 15 can be inserted. The insertion holes 14*a* are formed so as to open to end faces of both end portions of the inner bar 14. Each insertion hole 14*a* is formed so that a center thereof is substantially matched with the shaft center of the inner bar 14, when seeing the inner bar 14 in the axis line direction. Also, a depth dimension of the insertion hole 14*a* is set greater than a protruding amount of the support shaft 17 of the ring temple 15, which protrudes from the body part 18 on the opposite side to the shaft part 19-side, as described above.

In the ring bar temple 13, the other end portion of the shaft support shaft 17 of each ring temple 15 is inserted in the insertion hole 14*a* of the inner bar 14, so that each ring temple 15 is attached to the inner bar 14. Thereby, as described above, the shaft center of the support shaft 17 of each ring temple 15 is matched with the shaft center of the inner bar 14. In the present embodiment, an outer diameter of each body part 18 of each ring temple 15 and an outer diameter of the inner bar 14 are substantially the same. Therefore, positions of the outer peripheral surfaces of both the body part and the inner bar of the ring bar temple 14 are substantially matched, so that both the outer peripheral surfaces are continuous to each other.

Note that, a hole diameter of the insertion hole 14*a* of the inner bar 14 is set so that the support shaft 17 is loosely fitted in the inner bar 14 in the state where the other end portion of the support shaft 17 is inserted. In addition, the attaching of the ring temple 15 to the inner bar 14 is made simply by the insertion (loose fitting) of the support shaft 17 into the insertion hole 14*a*. Therefore, the ring bar temple 13 is configured so that each ring temple 15 can be attached and detached with respect to the inner bar 14. Further, in the ring bar temple 13, the inner bar 14 and the ring temple 15 (support shaft 17) can relatively rotate to each other, in the attached state.

In the full-width temple device 2 configured as described above, in the present embodiment, the cover 11 is configured so that a part corresponding to each ring temple 15 and the other part can be divided from each other in the width direction (a direction that coincides with the weaving width direction in the state where the full-width temple device 2 is mounted on the loom 1). More specifically, end portions of the cover 11 corresponding to the ring temples 15 in the width direction and a portion between both the end portions are each formed as separate members. Specifically, the cover 11 is constituted by two members (end-side members) forming each of the end portions and a member (center member) forming a part between the two end-side members.

Note that, in the cover 11 configured in this way, a dimension in the width direction of each of the end-side members is greater than the dimension in the axis line direction of the ring temple 15. Therefore, in the full-width temple device 2, boundaries between each of the end-side members and the center member of the cover 11 are positioned on more inner sides than both ends of the inner bar 14 in the axis line direction of the ring bar temple 13. The cover 11 is configured so that each of the end-side members and the center member are each attached to the base plate 10*a* of the base body 10. Thereby, the cover 11 is configured to be dividable between each of the end-side members and the center member.

The base plate 10*a* of the base body 10 is also configured to be dividable into a part on a yarn supply-side and a part on an opposite side to the yarn supply-side within the presence range of the inner bar 14 of the ring bar temple 13 with respect to the width direction (the direction that coincides with the weaving width direction in the state where the full-width temple device 2 is mounted on the loom 1). Specifically, the base plate 10*a* includes a member (a member on the opposite side to the yarn supply-side) performing as a part on the opposite side to the yarn supply-side and a member (a member on the yarn supply-side) performing as a part on the yarn supply-side. In the present embodiment, the member on the opposite side to the yarn supply-side and the member on the yarn supply-side are sized so that a boundary position therebetween is substantially matched with the boundary between the end-side member on the opposite side to the yarn supply-side and the center member of the cover 11 with respect to the width direction. The base plate 10*a* is configured so that the member on the opposite side to the yarn supply-side and the member on the yarn supply-side are each attached to the brackets 4. Thereby, the base plate 10*a* is configured to be dividable between the member on the opposite side to the yarn supply-side and the member on the yarn supply-side.

In the full-width temple device 2 as described above, when detaching the ring bar temple 13 for maintenance and the like, an operation of detaching the cover 11 from the base body 10 is first performed. In this case, the full-width temple device 2 is configured so that the ring bar temple 13 is supported by the base body 10, and the cover 11 is provided in the full-width temple device 2 in a state where it has nothing to do with the ring bar temple 13 except an attaching part to the base body 10 (base plate 10*a*). In other words, the cover 11 is provided so that it has nothing to do with the other part of the full-width temple device 2 when it is simply detached from the base body 10 (when the screw member 40 that attaches the cover 11 to the base body 10 is simply detached). Therefore, when detaching the cover 11, it is only necessary to release the attached state of the cover 11 to the base body 10, so that the detaching operation can be easily performed.

After the operation of detaching the cover 11 from the base body 10 is performed, as described above, an operation of detaching the ring bar temple 13 from the base plate 10*a* is performed. Note that, in the full-width temple device, the ring bar temple 13 is supported by the base body 10 in a state of being engaged at both the shaft parts 19 and 19 with members (engaging members) that are engaged with the ring bar temple 13 attached to the base plate 10*a*. Therefore, when detaching the ring bar temple 13, it is necessary to release an engaged state between at least one shaft part 19 and the engaging member. In this case, when the engaging member is the support part 10*b* of the base body 10, the support part 10*b* should be detached from the base plate 10*a*.

Regarding this, in the full-width temple device 2, the engaging member is the attachment member 30 attached to the support part 10*b*. Also, the attachment member 30 is attached to the support part 10*b* by the screw members 22 inserted from the inner side (base plate 10*a*-side) of the base body 10 with respect to the width direction. Therefore, when detaching the ring bar temple 13 from the base plate 10*a*, an operation of detaching the attachment member 30 from the base body 10 (support part 10*b*) is performed. This detaching operation can be performed in a form of loosening the screw members 22 from the inner side of the base body 10 with respect to the support part 10*b* in the width direction.

Specifically, the detaching operation can be performed without interfering with the peripheral devices such as the cutter devices 6 and 7 and the like arranged on both the outer sides (the outer sides of the attachment members 30 attached to both the support parts 10*b*, 10*b* of the base body 10) of the full-width temple device 2 in the weaving width direction on the loom 1 and can be thus performed without detaching the peripheral devices. Thereby, it is possible to easily perform the operation of detaching the ring bar temple 13 from the base plate 10*a*.

As described above, according to the full-width temple device 2 of the present embodiment, the operation of detaching the ring bar temple 13 from the full-width temple device 2 can be easily performed as a whole because the operation of detaching the cover 11 from the base body 10 and the operation of detaching the ring bar temple 13 from the base plate (the operation of detaching the attachment members 30 from the base body 10) can be easily performed as described above.

Also, according to the full-width temple device 2 of the present embodiment, the engaging part of each attachment member 30 is constituted by the engaging hole 32 in which the shaft part 19 of the ring bar temple 3 is fitted. In addition, as described above, each shaft part 19 is formed to have the planar portion 19*a* on the circumferential surface thereof, each engaging hole 32 is formed to have the contact surface 32*a* on the inner peripheral surface thereof, and the angle (phase) of the ring bar temple 13 around the axis line in the state of being supported by the base body 10 is restrained (prescribed) by the planar portion 19*a* and the contact surface 32*a*.

Therefore, even though the engaged state between the ring bar temple 13 and the attachment member 30 is released for maintenance and the like after detaching the ring bar temple 13 from the base body 10 as described above, when re-attaching the ring bar temple 13 after the detaching, the phase can be easily reproduced without adjustment and the like simply by fitting each shaft part 19 of the ring bar temple 13 in the engaging hole 32 of the attachment member 30 and then attaching the attachment member 30 to the base body 10 (shaft part 10*b*).

In addition, as described above, the attaching of the ring bar temple 13 to the attachment member 30 is performed in the state where the shaft part 19 is engaged in the engaging hole 32. In the full-width temple device 2, as the fixing means for fixing the attached state, the split clamping structure 33 configured as described above is adopted, as described above, and the fixing is made in a form of tightening the shaft part 19. Specifically, in the attached state, the fixing is made in a state where there is no gap between the shaft part 19 and the inner peripheral surface of the engaging hole 32. Thereby, the wear that is caused when there is a gap between the shaft part 19 and the inner peripheral surface of the engaging hole 32 is not caused, so that it is possible to increase the service life of the shaft part 19 and the attachment member 30 having the engaging hole 32.

Further, in the full-width temple device 2, the cover 11 is constituted by the end-side members corresponding to the positions of the ring temples 15 and the center member between the end-side members at both the end portions, and the respective members are attached to the base plate 10*a*. Therefore, the end-side members and the center member of the cover 11 can be individually detached from the base plate 10*a*. In other words, the cover 11 is configured so that only the end-side members can be detached from the base plate 10*a* without detaching the entire cover. Note that, when only the end-side members are detached, the ring bar temple 13 is in a state where the ring temples 15 are exposed to the outside.

Further, each ring temple 15 of the ring bar temple 13 is configured to be attached and detached with respect to the inner bar 14. Therefore, in a state where only the end-side members of the cover 11 are detached, the inner bar 14 of the ring bar temple 13 is mostly accommodated in the space 12. However, even in this state, the ring temples 15 exposed as described above can be detached from the full-width temple device 2. Thereby, in a case where a target of maintenance or the like on the ring bar temple 13 is only the ring temples 15, the ring temples 15, which are a target of maintenance or the like, can be detached simply by detaching only the end-side members without detaching the entire cover 11, so that the operation can be easily performed.

In addition, in the full-width temple device 2, the cover 11 is configured as described above, and the base plate 10*a* is configured to be dividable between the member on the opposite side to the yarn supply-side and the member on the yarn supply-side. Thereby, it is possible to deal with a change in weaving width of the woven fabric W to be woven, especially a change to reduce the weaving width by cutting.

Specifically, the full-width temple device 2 is configured to hold both end portions of the woven fabric W to be woven by the ring temples 15 of the ring bar temple 13. For this reason, it is necessary for the ring bar temple 13 to have a length dimension (a dimension in the axis line direction) that matches a weaving width of the woven fabric W to be woven and thus enables both the ring temples 15 to be positioned at both end portions of the woven fabric W. In this case, when changing the woven fabric W to be woven into a woven fabric having a smaller weaving width, the ring bar temple 13 can be made to have a length dimension corresponding to the changed weaving width by cutting the end portions of the ring temples 15 with respect to the inner bar 14 because the inner bar 14 and the ring temples 15 can be attached and detached.

In the meantime, the cover and the base plate are each formed with the cover-side concave part and the base-side concave part for avoiding interference with the needles of each ring of the ring bar temple, as described above. In addition, in a case where the cover and the base plate are each formed as a single member, when it is intended to cut the end portions thereof according to the change in weaving width, a positional relationship between the cover-side concave part and base-side concave part and the presence range of the ring in the axis line direction does not match. Therefore, it is not possible to deal with the change by cutting the end portions, and in this case, it is necessary to prepare covers and base plates having width dimensions (dimensions in the length direction) corresponding to all of the assumed weaving widths.

In contrast, according to the full-width temple device 2, the cover 11 is configured so that each of the end-side members and the center member can be divided, as described above. Therefore, when the end portions of the center member are cut, for example, it is possible to adjust the entire width dimension of the cover to the changed weaving width. In addition, the base plate 10*a* is configured so that the member on the opposite side to the yarn supply-side and the member on the yarn supply-side are dividable. Therefore, when an end portion on the opposite side to the base-side concave portion (not shown) of both end portions of the member on the yarn supply-side is cut, for example, it is possible to adjust the entire width dimension of the base plate to the changed weaving width.

By dealing in this way, while the width dimensions of the cover 11 and the base plate 10*a* are made to correspond to the changed weaving width, the positional relationship between the cover-side concave part and base-side concave part and the presence range of the rings 16 can be maintained matched. Therefore, in the full-width temple device 2 where the cover 11 and the base plate 10*a* are configured as described above, it is possible to deal with the change in weaving width even though the covers and base plates having the width dimensions corresponding to all of the assumed weaving widths are not prepared in advance.

In addition, in the full-width temple device 2, as described above, the hole diameter of each through-hole 10*b*2 at the other end portion of each support part 10*b* is slightly greater than the diameter of the screw member 22, so that the attaching position of the attachment member 30 to the support part 10*b* can be adjusted. Therefore, in the full-width temple device 2, the support position of the ring bar temple 13 supported by the attachment members 30 attached to each of the support parts 10*b* can be adjusted to positions corresponding to the weaving conditions and the like.

Note that, the present invention is not limited to the above embodiment, and can also be implemented in other modified aspects (modified embodiments), as described in following (1) to (7).

(1) In the above embodiment, the attachment member 30 is formed as a flat plate-shaped member, and is attached to the support part 10*b* by the screw members 22, which are inserted in the plate thickness direction of the support part 10*b*, from the inner side of the base body 10 with respect to the support part 10*b*. However, in the present invention, the attachment member is not limited to such configuration. Specifically, the attachment member may be configured different from the above embodiment, if the attaching to the support part is not performed in a form of inserting the screw members from an outer side of the full-width temple device in the weaving width direction, i.e., if the attaching and detaching does not require detaching of the peripheral devices.

Figure 8:
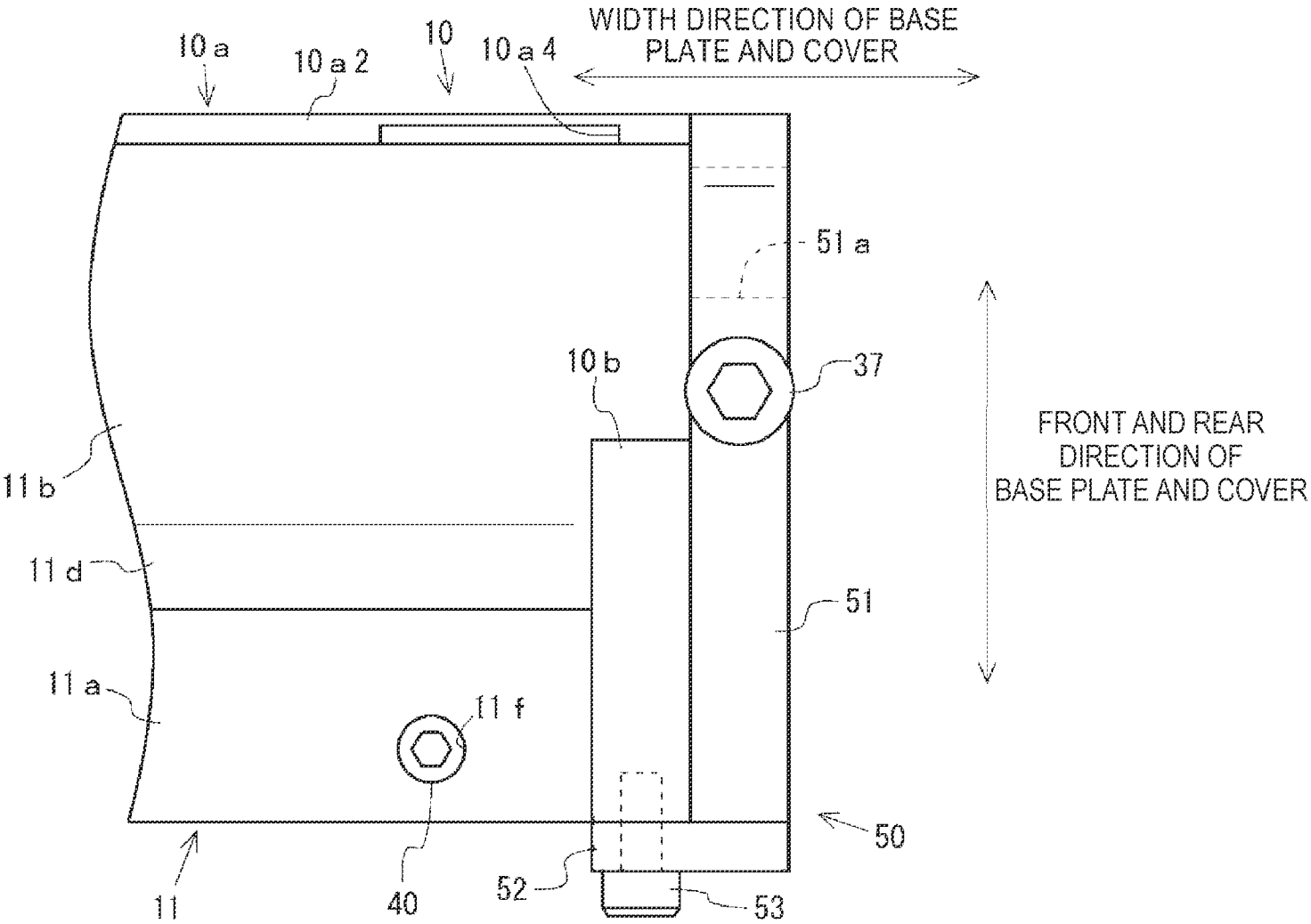
FIG. 8 is a plan view showing an example of the attachment member having a protrusion protruding toward a support part.

As a configuration of such attachment member, a configuration shown in FIG. 8 is considered, for example. In the configuration of FIG. 8, an attachment member 50 is formed so that a part (shaft fixing part) 51 functioning as the shaft fixing part is substantially the same as the above embodiment. However, the attachment member 50 is configured to have a protrusion 52 formed to protrude from the shaft fixing part 51 in a plate thickness direction and provided to maintain the shaft fixing part 51 in a state of being attached to the support part 10*b*. In the shown example, the protrusion 52 is formed to continue to an end edge (rear end edge) on an opposite side to a side on which an engaging part 51*a* is formed, with respect to a long side direction of an end face of the shaft fixing part 51.

The attachment member 50 is attached to the support part 10*b* by a screw member 53 inserted in the protrusion 52 with the shaft fixing part 51 facing the support part 10*b*, like the attachment member 30 of the above embodiment. Specifically, the attachment member 50 is attached to the support part 10*b* by the screw member 53 whose insertion direction is made to face toward the front and rear direction of the full-width temple device. Therefore, even with this configuration, the attachment member 50 can be attached and detached with respect to the support part 10*b* without detaching the peripheral devices and the like, for example.

Note that, in the example of FIG. 8, the attachment member 50 may be formed as a single member including the shaft fixing part 51 and the protrusion 52, which are integrally formed, or may have a configuration where the shaft fixing part 51 and the protrusion 52 formed as separate members are combined. Specifically, in the present invention, the attachment member is not limited to the configuration where it is formed as a single member. Also, in the example of FIG. 8, the attachment member 50 has the configuration where the protrusion 52 is formed to continue to the rear end edge of the shaft fixing part 51. However, instead of this configuration, the attachment member 50 may also be configured so that the protrusion is formed to continue to an end edge becoming an upper side of the full-width temple device, which is one end side in a short side direction of an end face of the shaft fixing part 51. In this case, the insertion direction of the screw member for attaching the attachment member to the support part 10*b* is an upper and lower direction.

(2) As for the base body (support part) and the attachment member, in the above embodiment, the base body 10 and the attachment member are configured so that the shaft fixing part of the attachment member is positioned on the outer side of the support part 10*b* of the base body 10 in the width direction. However, in the present invention, the base body and the attachment member are not limited to such configuration, and may also be configured so that the shaft fixing part of the attachment member and the support part are positioned in substantially the same positions in the width direction.

Figure 9:
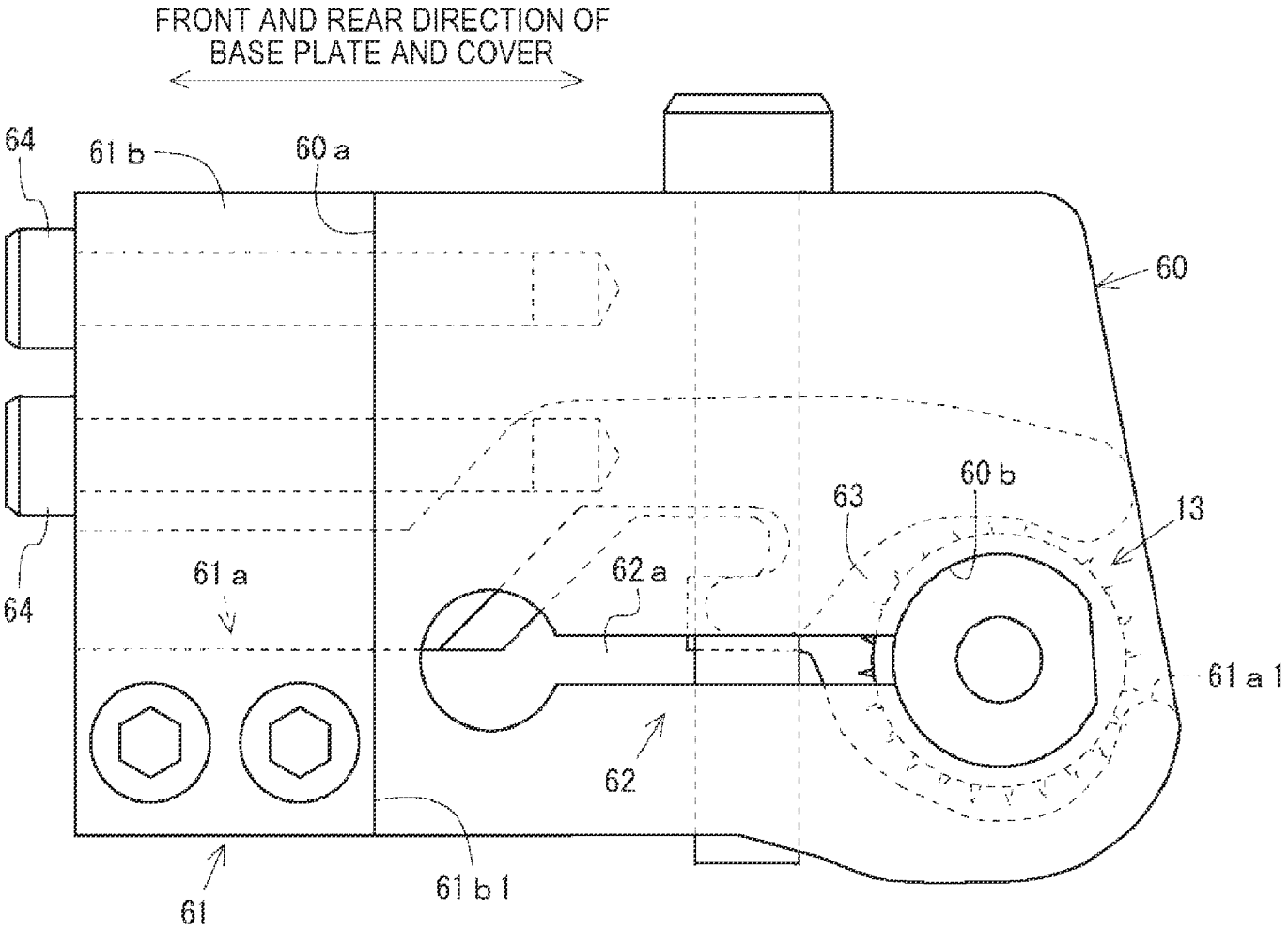
FIG. 9 is a side view showing an example of the support part and the attachment member (shaft fixing part) provided in the same positions in a width direction of a base plate and a cover.

As a configuration of such base body and attachment member, a configuration shown in FIG. 9 is considered, for example. In the configuration of FIG. 9, a base plate 61*a* of a base body 61 is not provided with the concave portion at the part to which the support part 10*b* like the base plate 10*a* of the above embodiment is attached, and a support part 61*b* is configured to be attached to the base plate 61*a* in arrangement of not overlapping the base plate 61*a* in the width direction.

As for the attachment member 60, the fixing means is a split clamping structure 62, like the above embodiment. In addition, the attachment member 60 is attached to the support part 61*b* by screw members 64 inserted in the support part 61*b* in a form of bringing one side surface 60*a* of side surfaces on both sides with respect to an extension direction of a slit 62*a* of the split clamping structure 62 into contact with a side surface 61*b*1, which faces toward a base-side guide part 61*a*1 of the base plate 61*a*, of the support part 61*b* attached to the base plate 61*a*. Thereby, the attachment member 60 (shaft fixing part) and the support part 61*b* are located in substantially the same positions in the width direction. Note that, in a state of being attached to the support part 61*b*, the attachment member 60 is formed to be in a state where it is located in a position in which an engaging part 60*b* overlaps a space 63, in which the ring bar temple 13 is accommodated, as seen in the width direction.

(3) As for the fixing means for attaching the ring bar temple to the attachment member, in the above embodiment, the split clamping structure 33 is used as the fixing means. However, in the present invention, the fixing means may be a well-known means, for example, a means using a fixing screw, in addition to the split clamping structure.

(4) As for the shaft part of the ring bar temple and the engaging part (engaging hole) of the attachment member, in the above embodiment, the shaft part 19 of the ring bar temple 13 is formed to have the planar portion 19*a* on the circumferential surface thereof, and the engaging hole 32 is formed to have the planar contact surface 32*a*, which is in contact with the planar portion 19*a* of the shaft part 19, on the inner peripheral surface thereof. However, in the present invention, even when the engaging part of the attachment member is the engaging hole, the shaft part and the engaging hole are not limited to those formed as in the above embodiment.

For example, the shaft part may be formed to have a circular section, and the engaging hole may be formed to have a hole shape in which the shaft part is inserted. However, in this case, since the phase is not restrained even though the shaft part is fitted in the engaging hole, it is necessary to adjust the angle of the ring bar temple around the axis line in a state where the shaft part is fitted in the engaging hole. In addition, the shaft part may be formed to have two or more planar portions on the circumferential surface, such as a polygonal section, and the engaging hole may be formed to have a hole shape in which the shaft part is fitted.

(5) As for the engaging part of the attachment member, in the above embodiment, the engaging part is formed as the hole-shaped engaging hole 32 formed as a through-hole. Specifically, the engaging part is formed into the hole shape that is entirely engaged with the circumferential surface of the shaft part 19. However, in the present invention, the engaging part of the attachment member is not limited to the hole shape, and may also be formed into a notch shape that is partially engaged with the circumferential surface of the shaft part.

Figure 10:
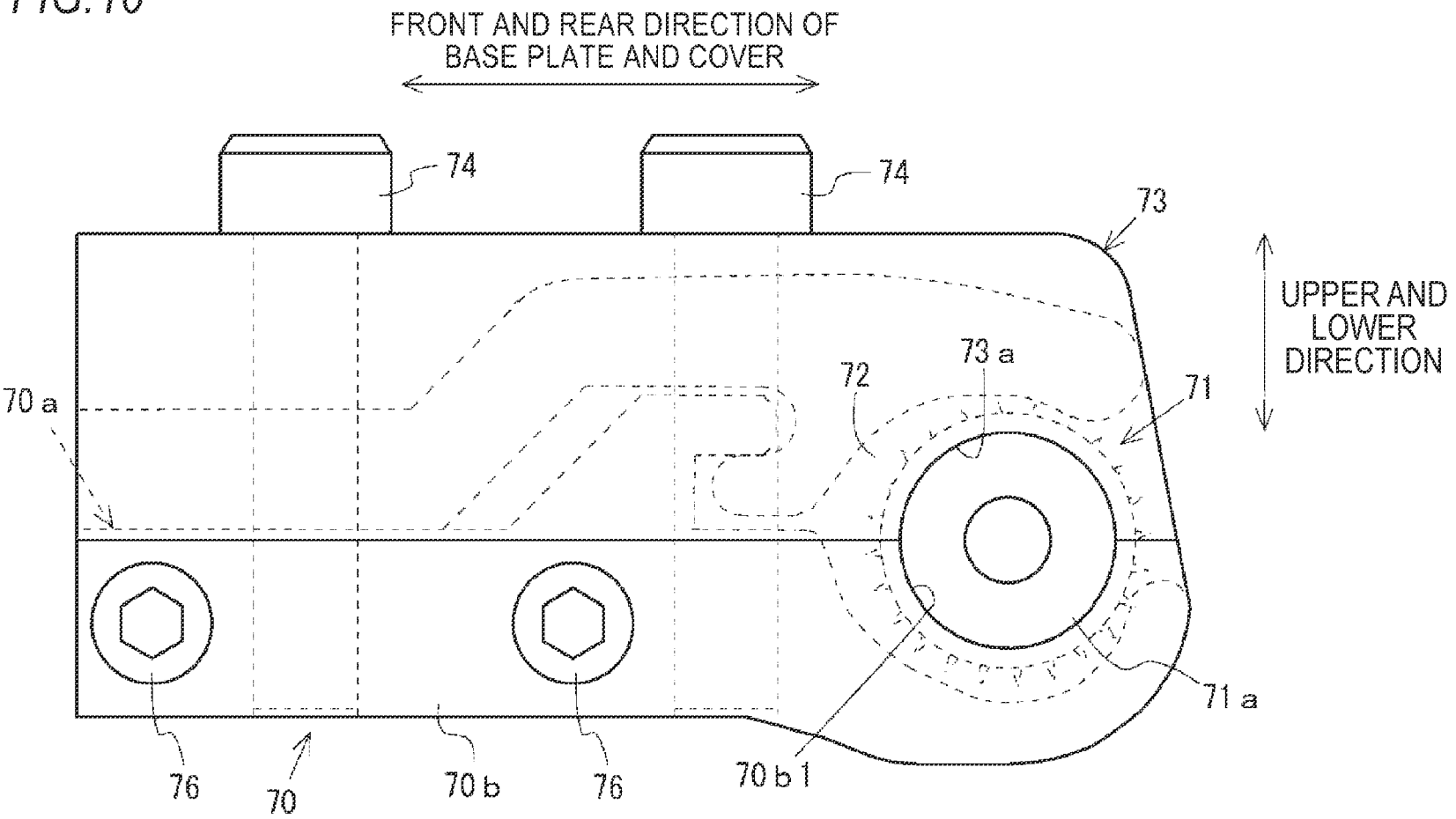
FIG. 10 is a side view showing an example of the attachment member where an engaging part is formed into a notch shape that is partially engaged with a circumferential surface of a shaft part.

As a configuration of the attachment member having the engaging part formed in such a way, a configuration shown in FIG. 10 is considered, for example. In the configuration shown in FIG. 10, similar to the example shown in FIG. 9, a base body 70 is configured so that a support part 70*b* is attached to a base plate 70*a* in arrangement of not overlapping the base plate 70*a* in the width direction. In addition, the support part 70*b* is attached to the base plate 70*a* by screw members 76 screwed in the base plate 70*a* in positions similar to the above embodiment. However, the support part 70*b* is configured as a member extending to a position of a space 72, in which a ring bar temple 71 is accommodated, in the front and rear direction, in the attached state. In addition, the support part 70*b* has such a size that a position of an upper surface thereof is located near a center of the space 72 in the upper and lower direction, in the attached state.

Further, an attachment member 73 is attached to the support part 70*b* in a form of being placed on the upper surface of the support part 70*b*. In addition, the attachment member 73 is configured as a member whose presence range in the front and rear direction is substantially matched with the support part 70*b*, in the attached state. Thereby, in the attached state, the attachment bar 73 and the support part 70*b* are present so that a boundary position in the upper and lower direction is located near the center of the space 72 and overlaps the space 72 as seen in the width direction.

Note that, in the shown example, a shaft part 71*a* of the ring bar temple 71 is formed to have a circular section. In addition, the ring bar temple 71 is accommodated in the space 72 in arrangement where a position of a shaft center of the shaft part 71*a* is located near the center of the space 72. Therefore, the attachment member 73 is configured to have an engaging part 73*a* formed as a notch having a substantially semicircular shape so that it is partially engaged with the shaft part 71*a* in a position of a substantially upper half.

The support part 70*b* is also notched into a substantially semicircular shape at a portion facing the engaging part 73*a* of the attachment member 70 in a state where the attachment member 73 is attached as described above, so as to allow arrangement of the shaft part 71*a* of the ring bar temple 71 because the support part 70*b* overlaps the space 72 as seen in the width direction, as described above. In addition, the shaft part 71*a* (ring bar temple 71) is supported by the support part 70*b* and the attachment member 73 in a form of being introduced into a hole-shaped space formed by a notch 70*b*1 of the support part 70*b* and the engaging part 73*a* of the attachment member 73 formed as a result of being notched in this way.

Note that, the attaching of the attachment member 73 to the support part 70*b* is performed in such a form that the screw members 74 inserted in the attachment member 73 in the upper and lower direction are screwed into the support part 70*b*. In addition, the engaging part 73*a* of the attachment member 73 formed into the semicircular shape as described above and the notch 70*b*1 of the support part 70*b* are formed so that curvature radii thereof are substantially the same as a radius of the shaft part 71*a*. However, at least one of the engaging part 73*a* and the notch 70*b*1 is formed so that an arc angle of an arc-shaped inner peripheral surface is slightly smaller than 180°. Therefore, in a state where the shaft part 71*a* is introduced into the engaging part 73*a* and the support part 70*b*, the screw members 74 are tightened, so that the shaft part 71*a* is tightened by both the inner peripheral surfaces of the engaging part 73*a* and the notch 70*b*1. Thereby, in a state of being supported to the support part 70*b* and the attachment member 73 by the shaft part 71*a*, the ring bar temple 71 is fixed to both the members.

(6) In the above embodiment, in the case where the target of maintenance or the like of the ring bar temple 13 is only the ring temple 15, the ring bar temple 13 is configured so that each ring temple 15 can be attached and detached with respect to the inner bar 14, so as to facilitate the operations associated with the maintenance or the like. In addition, the cover 11 is configured to be dividable into the end-side members corresponding to the positions of the ring temples 15 and the center member between both the end-side members.

However, in the present invention, the ring bar temple is not limited to the configuration where the ring temple can be attached and detached with respect to the inner bar 14, like the above embodiment. For example, the ring bar temple may have a configuration where a through-shaft over the axis line direction of the ring bar temple is configured as a support shaft, the body part and the rings constituting the ring temple are supported at each of both end portions of the support shaft and a hollow cylindrical inner bar is rotatably supported between the ring temples. By the configuration, the ring bar temple is configured so that the ring temple cannot be attached and detached with respect to the inner bar.

In a case where the ring bar temple is configured in such a way, even when the cover is configured to be dividable and only the end-side member is detached, the operation cannot be performed in terms of maintenance or the like. For this reason, in this case, the cover is preferably configured not to be dividable. For example, the cover may be formed as a single member where parts corresponding to the ring temples and a part except the parts are integrated. In this way, in the full-width temple device of the present invention, the cover is not limited to the dividable configuration like the above embodiment, and may also be configured not to be dividable, such as a single member.

The dividable configuration of the cover can also be applied to not only a case for maintenance or the like but also a case for dealing with a change in weaving width of reducing a weaving width of the woven fabric to be woven. Therefore, even when the ring bar temple is configured so as not to be attachable and detachable as described above, the cover may be configured to be dividable for the purpose of dealing with the change in weaving width.

Note that, as for the division positions of the cover, the division positions are not limited to the positions in the above embodiment, and can be set to any positions according to the purpose and the like of the cover. Specifically, when the purpose is to deal with both maintenance or the like and the change in weaving width, the division positions may be more inner positions than the positions of the above embodiment or may be positions of both ends of the inner surface 14. In addition, when the purpose is to deal with only the change in weaving width, the division positions are not limited to the positions within the presence range of the inner bar, and may be positions between the inner bar and the cover-side concave part.

In addition, as for the configuration of the cover, when the cover is configured to be dividable so as to only deal with the change in weaving width, the cover is not limited to the configuration where it is constituted by the three members of the two end-side members and the center member, like the above embodiment, and may be constituted by two members of a member becoming a part on the opposite side to the yarn supply-side and a member becoming a part on the yarn supply-side, similar to the base plate 10*a* of the above embodiment.

Further, as for the base plate, in the above embodiment, the base plate 10*a* is configured to be dividable into the member on the opposite side to the yarn supply-side and the member on the yarn supply-side so as to deal with the change in weaving width, similar to the cover 11. However, in the present invention, the base plate is not limited to the dividable configuration, and may also be configured not to be dividable when it is unnecessary to deal with the change in weaving width, by the cutting like the above embodiment. Note that, when the base plate is configured not to be dividable, for example, the base plate may be formed as a single member where the member on the opposite side to the yarn supply-side and the member on the yarn supply-side are integrated. In addition, when the base plate is configured to be dividable, the division position of the base plate is not limited to the position in the above embodiment, and may be a position other than the position in the above embodiment between both the base-side concave parts of the base plate.

(7) In the above embodiment, the ring bar temple 13 is configured so that the outer diameter of each body part 18 of each ring temple 15 and the outer diameter of the inner bar 14 are substantially the same. However, in the present invention, the ring bar temple is not limited to such configuration, and may also be configured so that the outer diameter of each body part of each ring temple is smaller than the outer diameter of the inner bar. However, in this case, the ring bar template is preferably configured so that the needles of each ring of each ring temple protrude from the outer peripheral surface, when seeing the inner bar in the axis line direction, similar to the above embodiment.

The present invention is not limited to the above embodiment and the modified embodiments, and can be variously changed without departing from the gist of the present invention.

What is claimed is:

1. A temple device for a loom, the temple device configured to extend over a full width of a woven fabric, comprising:

a base body comprising a base plate configured to extend over the full width of the woven fabric near a cloth fell;

a cover configured to extend over the full width on the base plate; and a temple bar configured to extend over the full width and accommodated in a space defined by the base plate and the cover, the base plate including a base-side guide part configured to define the space together with the cover and to sandwich the woven fabric in cooperation with the temple bar, and the temple device being configured to hold the woven fabric over the full width thereof by the base-side guide part of the base plate, the cover and the temple bar, where the temple bar is a ring bar temple constituted by a rod-shaped inner bar and ring temples provided continuously to both sides of the inner bar and having shaft parts for support at both ends, and where each of the ring temples is configured to include: a plurality of rings with a plurality of needles protruding from an outer peripheral surface; and a support shaft configured to support each ring, wherein the base body has support parts at both end portions for supporting the ring bar temple on the shaft parts, the support parts being attached to the base plate, wherein the temple device comprises attachment members each detachably attached to each of the support parts and comprising a plate-shaped shaft fixing part, and wherein each shaft fixing part has an engaging part formed to fit with a respective shaft part while being partially or entirely in contact with a circumferential surface of the respective shaft part.

2. The temple device according to claim 1, wherein the engaging part is a hole-shaped engaging hole formed in the shaft fixing part, and wherein each of the shaft parts of the ring bar temple has a plane shape formed on a part of the circumferential surface thereof, and the engaging hole is formed into a hole shape in which the shaft part is fitted.

3. The temple device according to claim 2, wherein the shaft fixing part of the attachment member is formed with a slit configured to communicate with the engaging hole, a through-hole opening to one facing surface of two facing surfaces of the slit and penetrating through the attachment member in a direction orthogonal to the one facing surface, and a female thread hole opening to a position on another facing surface facing the through-hole of the two facing surfaces, and wherein the temple device comprises a screw member inserted in the through-hole of the attachment member and screwed into the female thread hole.

4. The temple device according to claim 3, wherein the ring bar temple is configured so that the ring temples can be attached and detached with respect to the inner bar, and wherein the cover is configured to be dividable in positions of both ends of the inner bar or on more inner sides than the positions, with respect to a weaving width direction that is a direction of the full width.

5. The temple device according to claim 4, wherein the base plate is configured to be dividable within a presence range of the inner bar with respect to the weaving width direction.

6. The temple device according to claim 2, wherein the ring bar temple is configured so that the ring temples can be attached and detached with respect to the inner bar, and wherein the cover is configured to be dividable in positions of both ends of the inner bar or on more inner sides than the positions, with respect to a weaving width direction that is a direction of the full width.

7. The temple device according to claim 6, wherein the base plate is configured to be dividable within a presence range of the inner bar with respect to the weaving width direction.

8. The temple device according to claim 1, wherein the ring bar temple is configured so that the ring temples can be attached and detached with respect to the inner bar, and wherein the cover is configured to be dividable in positions of both ends of the inner bar or on more inner sides than the positions, with respect to a weaving width direction that is a direction of the full width.

9. The temple device according to claim 8, wherein the base plate is configured to be dividable within a presence range of the inner bar with respect to the weaving width direction.

* * * * *